US008387211B2

(12) United States Patent
Kutschat

(10) Patent No.: US 8,387,211 B2
(45) Date of Patent: Mar. 5, 2013

(54) ARRESTER FOR A VEHICLE DOOR OR VEHICLE HATCH

(75) Inventor: Horst Kutschat, Wuppertal (DE)

(73) Assignee: D. La Porte Söhne GmbH, Wuppertal (DE)

( * ) Notice: Subject to any disclaimer, the term of this patent is extended or adjusted under 35 U.S.C. 154(b) by 0 days.

(21) Appl. No.: 13/086,592

(22) Filed: Apr. 14, 2011

(65) Prior Publication Data

US 2011/0252599 A1 Oct. 20, 2011

(30) Foreign Application Priority Data

Apr. 15, 2010 (DE) ..... 10 2010 015 064

(51) Int. Cl.
*E05F 5/06* (2006.01)

(52) U.S. Cl. ..... 16/85; 16/82

(58) Field of Classification Search ..... 16/82, 85, 16/86 R, 86 A, 86 B, DIG. 6, DIG. 17; 49/364, 49/379; 180/69.21, 69.22, 69.23; 292/341.15, 292/341.12, 354, 355, 340, 341, DIG. 15, 292/DIG. 30; 296/76, 207, 155, 146.1
See application file for complete search history.

(56) References Cited

U.S. PATENT DOCUMENTS

| | | | | |
|---|---|---|---|---|
| 2,446,113 | A | 7/1948 | Spiller | |
| 2,667,778 | A | 2/1954 | Schmitt | |
| 2,863,200 | A | 12/1958 | Miller et al. | |
| 5,172,945 | A * | 12/1992 | Doherty et al. | 292/49 |
| 5,628,600 | A * | 5/1997 | Pasquini | 411/354 |
| 6,149,213 | A * | 11/2000 | Sokurenko et al. | 292/340 |
| 6,151,754 | A * | 11/2000 | Chen | 16/85 |
| 6,357,078 | B1 * | 3/2002 | Marzolf et al. | 16/82 |
| 6,584,642 | B2 * | 7/2003 | Hodson | 16/85 |
| 6,637,531 | B2 * | 10/2003 | Palenchar et al. | 180/69.21 |
| 6,976,289 | B1 * | 12/2005 | Luca | 16/76 |
| 7,703,754 | B2 * | 4/2010 | Siemer et al. | 267/140.13 |

FOREIGN PATENT DOCUMENTS

| | | |
|---|---|---|
| DE | 217 646 | 7/1914 |
| DE | 458 180 | 7/1926 |
| DE | 695 03 024 T2 | 2/1999 |
| DE | 101 27 425 A1 | 1/2002 |
| GB | 10599 | 4/1914 |
| GB | 2 306 542 | 5/1997 |
| GB | 2 363 424 | 12/2001 |

OTHER PUBLICATIONS

German Examination Report—Dec. 12, 2011.
German Search Report—Sep. 15, 2011.

* cited by examiner

*Primary Examiner* — Chuck Y. Mah
(74) *Attorney, Agent, or Firm* — Brinks Hofer Gilson & Lione

(57) ABSTRACT

An arrester (1) for locking a vehicle door or vehicle flap or the like in the open position has a male arrester part (2) for fastening to a first vehicle part, with a locking bolt (4), and a female arrester part (3) for fastening to a second vehicle part. The locking bolt (4) can be inserted into female arrester part. The second arrester part has a rotary latch mechanism for latching the inserted locking bolt (4) and a blocking element (118) for locking the rotary latch mechanism in the position latching the locking bolt (4). Both the male arrester part (2) and the female arrester part (3) have a pushbutton mechanism for releasing the locking of the rotary latch mechanism, the locking of the rotary latch mechanism being releasable by actuating either one of the pushbutton mechanisms.

30 Claims, 16 Drawing Sheets

ARRESTER FOR A VEHICLE DOOR OR VEHICLE HATCH

TECHNICAL FIELD OF THE INVENTION

The present invention relates to an arrester for locking a vehicle door or vehicle hatch in the open position thereof.

BACKGROUND OF THE INVENTION

Door arresters of this type serve, for example, for locking lift-up tailgates of a motor vehicle, in particular of a passenger vehicle, so that the load can be unloaded without obstruction. The two lift-up tailgates here are designed, for example, as hingedly mounted wing doors and each have a first, for example male, arrester part of the door arrester. A second, for example female, arrester part of the door arrester, which arrester part interacts with the first arrester part, is provided in each case on the vehicle body. The male arrester part has a locking bolt and the female arrester part has a rotary latch mechanism for enclosing and latching the locking bolt. When the lift-up tailgates are opened, the first and second parts of the door arrester enter into engagement with each other and hold the respective door in the open position thereof. In particular, the locking bolt is inserted into the female arrester part and latched thereby by the rotary latch mechanism. In order to lock the rotary latches of the rotary latch mechanism in the latching position, there is preferably a blocking element. Said locking and latching are released, for example, by means of a rotatable lever or a pushbutton which can be actuated from the inside of the vehicle door and which the female arrester part has.

However, door arresters are used not only for securing lift-up tailgates. In particular in special purpose vehicles, for example construction vehicles and/or forklift trucks, it is customary for the driver's door and/or passenger's door to be secured in an open position even while the vehicle is underway.

In addition, arresters of the type in question also serve to secure hatches of a vehicle in each case in the open position thereof.

The arresters are subjected to high loads. This is because, firstly, the vehicle doors of construction vehicles are of a considerable weight. Secondly, the construction vehicles frequently travel over uneven terrain, this resulting in relative movements between the vehicle door and body due to the shaking forces. As a consequence, the holding forces of the arrester have to be of a magnitude sufficient to ensure secure locking of the vehicle door even while the construction vehicles are underway and are being operated.

SUMMARY OF THE INVENTION

Therefore, it is the object of the present invention to provide an arrester for locking a vehicle door or vehicle hatch in the open position thereof with respect to the vehicle body, the arrester ensuring secure locking even during operation of the vehicle.

This object is achieved by an arrester in which both a male arrester part and a female arrester part have a pushbutton mechanism for releasing a locking of a rotary latch mechanism, and in which the locking of the rotary latch mechanism is releasable by actuation either one of the pushbutton mechanism.

BRIEF DESCRIPTION OF THE DRAWINGS

The invention is explained in more detail below by way of example with reference to a drawing, in which.

DETAILED DESCRIPTION OF THE DRAWINGS

Figure 1:
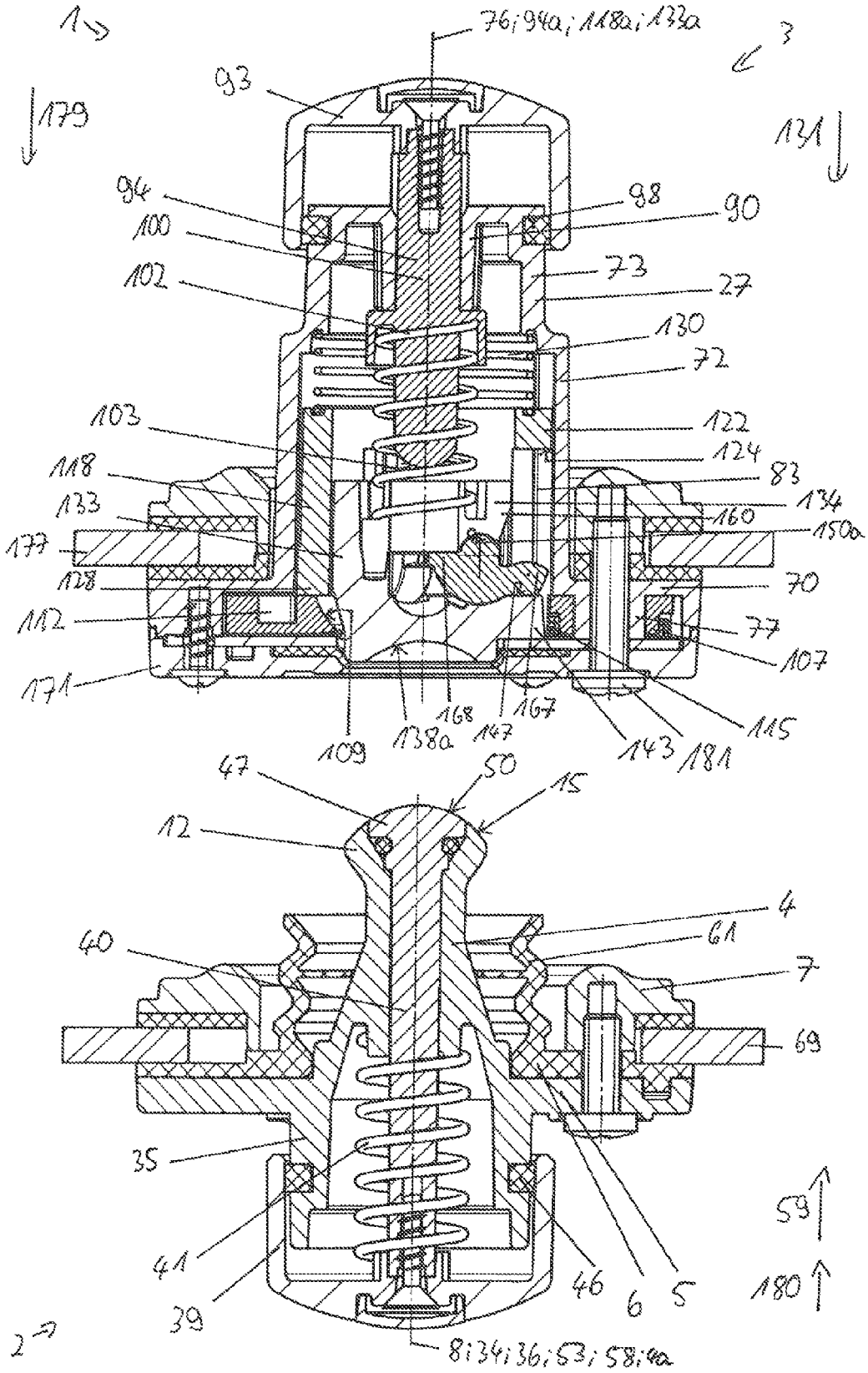
FIG. 1: shows a longitudinal section of an arrester according to the invention in an open position.
Figure 2:
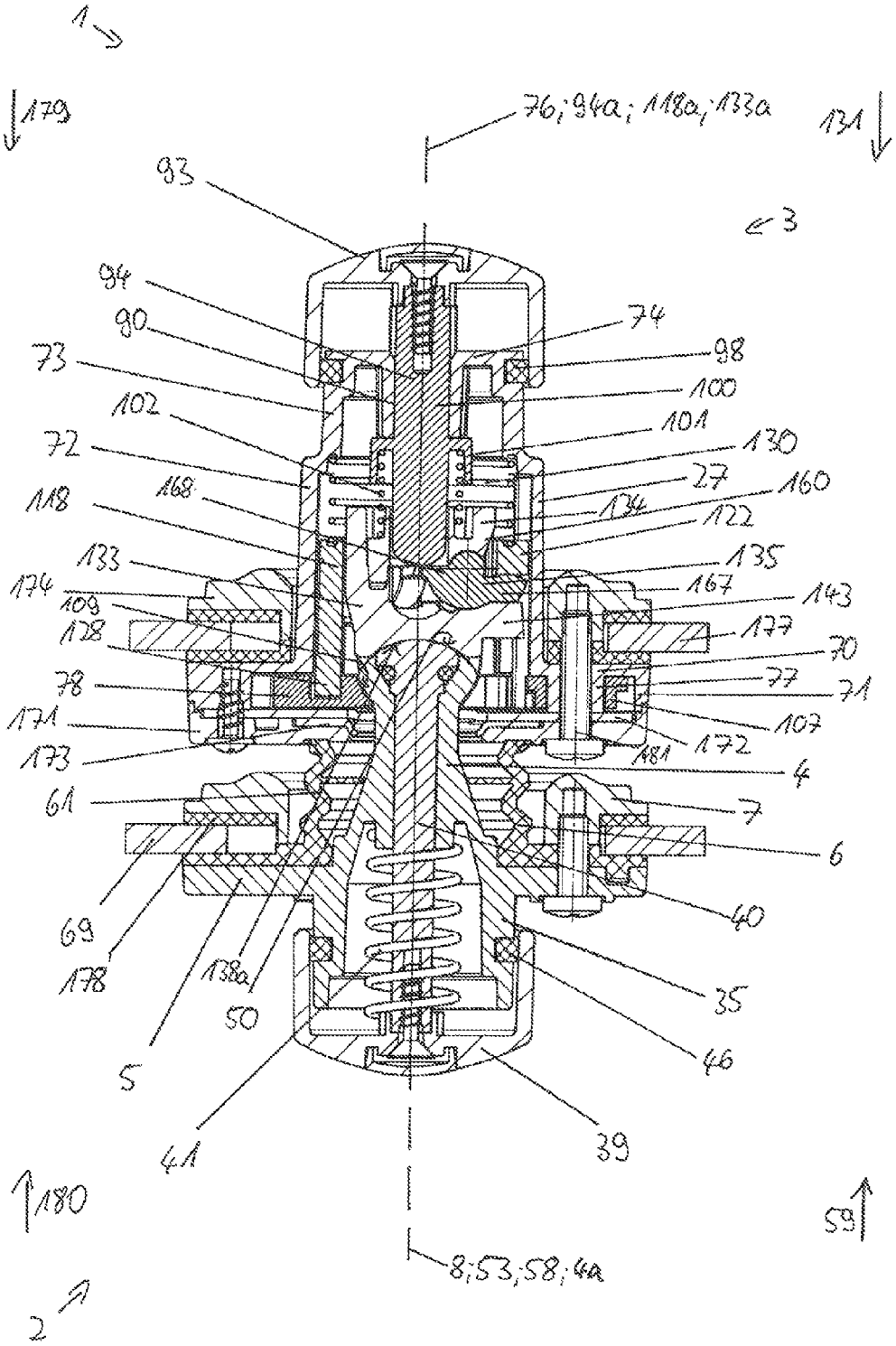
FIG. 2: shows a longitudinal section of an arrester according to the invention in a closed position.

The arrester according to the invention, in particular door arrester 1 (FIG. 1-4) has a first, male arrester part 2 and a second, female arrester part 3 which corresponds to the male arrester part 2 and interacts therewith. The male and female arrester parts 2, 3 can interact in a manner locking a vehicle door or vehicle hatch or the like in the open position thereof. For this purpose, for example, the male arrester part 2 is fastened to a first, in particular movable, vehicle part, for example the vehicle door or vehicle hatch, and the female arrester part 3 is fastened to a second vehicle part, for example the vehicle body, which is separate from the first vehicle part. However, this may also be reversed.

The male arrester part 2 (FIG. 1-4, 24) has a locking bolt 4, a pushbutton mechanism, a mounting plate 5, a buffer 6 and a cover plate or screw connection plate 7.

The locking bolt 4 (FIG. 1-5) has a longitudinal extent in the direction of a locking bolt axis 4*a*. The locking bolt 4 is expediently formed in a rotationally symmetrical manner with respect to the locking bolt axis 4*a*. In addition, the locking bolt 4 has a free plug-in end or head end 9 and a foot end 10 which is opposite the latter, as seen in a direction parallel to the locking bolt axis 4*a*. In addition, the locking bolt 4 is of hollow design and has a locking bolt cutout 11 which extends through the entire locking bolt 4 centrally and continuously in a direction parallel to the locking bolt axis 4*a*. At the plug-in end 9, the locking bolt 4 has a bolt head 12 which is adjoined by a bolt neck 13. The bolt head 12 is designed to be wider than the bolt neck 13. In particular, a bolt outer surface 14 in the region of the bolt head 12, as seen from the plug-in end 9, first of all has an actuating surface 15 which widens conically or in a cone-shaped manner from the plug-in end 9 to the foot end 10. That is to say, the cross section of the locking bolt 4 widens in the region of the actuating surface 15. In this case, the actuating surface 15 is preferably of curved design, in particular in the manner of a spherical surface or in the manner of a dome. The actuating surface 15 is adjoined by a first bolt outer surface section 16 tapering conically from the plug-in end 9 to the foot end 10. The actuating surface 15 and the conically tapering bolt outer surface section 16 merge one into the other via an encircling, preferably rounded bolt head edge 17. The conically tapering bolt outer surface section 16 is adjoined by a second, cylindrical bolt outer surface section 18. The diameter of the second, cylindrical bolt outer surface section 18 is smaller than the diameter of the edge 17. The second bolt outer surface section 18 is expediently adjoined by a third bolt outer surface section 19. The third bolt outer surface section 19 is of conical design and widens from the plug-in end 9 towards the foot end 10. The second and third bolt outer surface sections 18, 19 are arranged in the region of the bolt neck 13.

As seen from the plug-in end 9, the locking bolt cutout 10 first of all has a first, cylindrical or cylinder-jacket-shaped cutout section 20 and an adjoining, second cutout section 21 tapering conically or in a cone-shaped manner. The second cutout section 21 is adjoined by a third cutout section 22 which, in turn, is of cylindrical or cylinder-jacket-shaped design. The third cutout section 22 merges into a fourth cutout section 24 via two stepped shoulders 23 which are each in the shape of a segment of a circle. The two stepped shoulders 23 which are in the shape of a segment of a circle are arranged opposite each other, as seen in a direction perpendicular to the locking bolt axis 4*a*. The fourth cutout section 24 has two opposite, flat surface regions, as seen in a direction perpendicular to the locking bolt axis 4*a*, and two opposite surface regions, in a direction perpendicular to the locking bolt axis 4*a*, which surface regions are designed in the shape of a segment of a cylinder jacket. The two stepped shoulders 23 adjoin the flat surface regions.

In addition, at the foot end 10, the locking bolt 4 has a sleeve-like, tubular spring centering projection 25. The spring centering projection 25 has a, preferably slightly conical, projection outer surface 26.

In addition, the locking bolt 4 is connected fixedly, i.e. nondisplaceably and nonrotatably, to the mounting plate 5. The locking bolt 4 and the mounting plate 5 are preferably of integral design. The locking bolt 4 and/or the mounting plate 5 are/is expediently composed of plastic, in particular of PA 6 GF 30 (polyamide 6 with 30% glass fiber).

The mounting plate 5 has a first, preferably flat, mounting-plate surface 28*a* and a second, preferably flat, mounting-plate surface 28*b* which is parallel to the latter. The first mounting-plate surface 28*a* faces the locking bolt 4 and the second mounting-plate surface 28*b* faces away from the locking bolt 4. In addition, the mounting-plate surfaces 28*a,b* are expediently perpendicular to the locking bolt axis 4*a*. In addition, the mounting plate 5 has an encircling mounting plate edge 29 which is preferably of cylindrical or cylinder-jacket-shaped design. In addition, the mounting plate 5 has a buffer centering projection 30 protruding from the first mounting-plate surface 28*a*. The buffer centering projection 30 has a cylindrical or cylinder-jacket-shaped projection outer surface 31, wherein a projection cylinder axis 32 of the buffer centering projection 30 is arranged coaxially with respect to the locking bolt axis 4*a*. In addition, the mounting plate 5 has a mounting plate cutout 33 passing through the mounting plate 5 in the direction of the actuating axis 8. The mounting plate cutout 33 has a cutout axis 34 which is coaxial with respect to the locking bolt axis 4*a*.

A pushbutton mounting sleeve 35 is connected fixedly to the mounting plate 5. In particular, the mounting plate 5 and the pushbutton mounting sleeve 35 are of integral design. The pushbutton mounting sleeve 35 adjoins the second mounting-plate surface 28*b* and is arranged directed away from the locking bolt 4. The pushbutton mounting sleeve 35 has a pushbutton mounting-sleeve axis 36 which is coaxial with respect to the locking bolt axis 4*a*. In addition, the pushbutton mounting sleeve 35 has a cylindrical or cylinder-jacket-shaped sleeve outer surface 37, an annular groove 38 provided in the sleeve outer surface 37 and a sleeve end edge 37*a* in the shape of a circular ring.

The first pushbutton mechanism of the door arrester 1 according to the invention has a first, cap-shaped or hood-shaped pushbutton 39, a first ram 40 and a pushbutton spring 41. The pushbutton 39 has a cylinder-tube-shaped cap side wall 42 with a cylindrical or cylinder-jacket-shaped side wall inner surface 43 and a cap covering wall 44. In this case, a cylinder axis of the side wall inner surface 43 is preferably coaxial with respect to the locking bolt axis 4*a*. In addition, the pushbutton 39 is preferably of rotationally symmetrical design with respect to the locking bolt axis 4*a*. A plug-in sleeve 45 is integrally formed on the inside of the cap covering wall 44. The plug-in sleeve 45 is arranged centrally with respect to the extent of the cap covering wall 44. The pushbutton 39 is mounted on the pushbutton mounting sleeve 35 so as to be displaceable to and fro in the direction of a first actuating axis 8. The first actuating axis 8 is preferably parallel to, in particular coaxial with respect to, the locking bolt axis 4*a*. For this purpose, the pushbutton 39 is arranged with the side wall inner surface 43 around the sleeve outer surface 37. In addition, a sealing ring 46 is arranged in the groove 38, wherein the side wall inner surface 43 bears against the sealing ring 46 and is guided thereon.

The first ram 40 (FIG. 1-4, 6) has a longitudinal extent in the direction of a ram longitudinal axis 53 which is coaxial with respect to the locking bolt axis 4*a* and is preferably parallel to, in particular coaxial with respect to, the first actuating axis 8. In addition, the ram 40 has a ram head 47, an annular groove 48 adjoining the ram head 47 and a ram stem 49 adjoining the annular groove 48. The ram head 47 has a head surface 50 which is expediently designed in the manner of a dome or in the manner of a segment of a spherical surface. In addition, the ram head 47 has an encircling, cylinder-jacket-shaped head border surface 51 and a head lower side 52 which is opposite the head surface 50 and is preferably flat and perpendicular to the ram longitudinal axis 53. The head surface 50 and the head lower side 52 are each preferably of rotationally symmetrical design with respect to the ram longitudinal axis 53. In addition, the ram head 47 is designed in the manner of a spherical cap or as a segment of a sphere or spherical dome. The ram stem 49 is designed to be cylindrical with two planar flattened portions 54 opposite each other in a direction perpendicular to the ram longitudinal axis 53. The flattened portions 54 begin at a ram foot end 56 of the ram stem 49, which end is opposite the ram head 47, and end at a distance from the annular groove 48. As a result, the ram stem 49 below the ram head 47 has two shoulder surfaces 55 which are opposite each other in a direction perpendicular to the ram longitudinal axis 53. The shoulder surfaces 55 are each expediently formed perpendicularly to the ram longitudinal axis 53 and in the shape of a segment of a circular surface. The flattened portions 54 are oriented parallel to the ram longitudinal axis 53.

Furthermore, the first ram 40 is preferably composed of plastic, in particular of POM (polyoxymethylene).

The first ram 40 is firstly connected fixedly, i.e. nonrotatably and displaceably, but preferably releasably, to the first pushbutton 39. In particular, the ram stem 49 is connected at the ram foot end 56 to the cap covering wall 44. The ram stem 49 is preferably plugged at the ram foot end 56 into the plug-in sleeve 45, and the ram stem 49 and the cap covering wall 44 are screwed to each other. Furthermore, the ram 40 is guided with the ram stem 49 thereof in the locking bolt cutout 11 so as to be displaceable to and fro in the direction of the first actuating longitudinal axis 8 and so as otherwise to be nonrotatable. In particular, the cross-sectional shape of the fourth cutout section 24 of the locking bolt cutout 11 corresponds to the cross-sectional shape of the ram stem 49 in the region of the flattened portions 54. As a result, the ram stem 49 is guided in a form-fitting manner in the locking bolt cutout 11, in particular in the fourth cutout section 24.

In addition, the first ram 40 and the first pushbutton 39 are displaceable to and fro relative to the locking bolt 4 by a limited amount in the direction of the first actuating longitudinal axis 8. In particular, the ram 40 and the first pushbutton 39 can be displaced from a nonextended, retracted, unactuated starting position into an extended, actuated position. In the unactuated position, the ram 40 bears with the two shoulder surfaces 55 against the two stepped shoulders 23 or sits thereon. The stepped shoulders 23 serve as abutments for the movement of the ram 40 from the extended position thereof into the retracted position thereof. In addition, the actuating surface 15 of the locking bolt 4 and the head surface 50 of the ram 40 preferably end flush with each other and form a uniform segment of a spherical surface or a uniform, continuous surface in the shape of a segment of a spherical surface. In addition, a sealing ring 57 is expediently arranged in the annular groove 48. The sealing ring 57 bears against the second, conical cutout surface section 21 of the locking bolt cutout 11. The sealing ring 57 damps the impact of the shoulder surfaces 55 against the stepped shoulders 23.

Furthermore, the first pushbutton 39 and the first ram 40 are pressed by means of the pushbutton spring 41 into the retracted position and held there. The first pushbutton 39 and the ram 40 are therefore connected to the pushbutton spring 41 so as to be drivable counter to a first pushbutton actuating direction 59. The first pushbutton actuating direction 59 is parallel to the first actuating axis 8. The pushbutton spring 41 here is preferably a helical spring. The pushbutton spring 41 has a spring longitudinal axis 58 which is parallel to, in particular coaxial with respect to, the first actuating axis 8. For this purpose, the pushbutton spring 41 is arranged on the outside around the ram stem 49, the spring centering projection 25 and the plug-in sleeve 45 and is supported at one end on the inside of the cap covering wall 44 and at the other end on the foot end 10 of the locking bolt 4.

Figure 3:
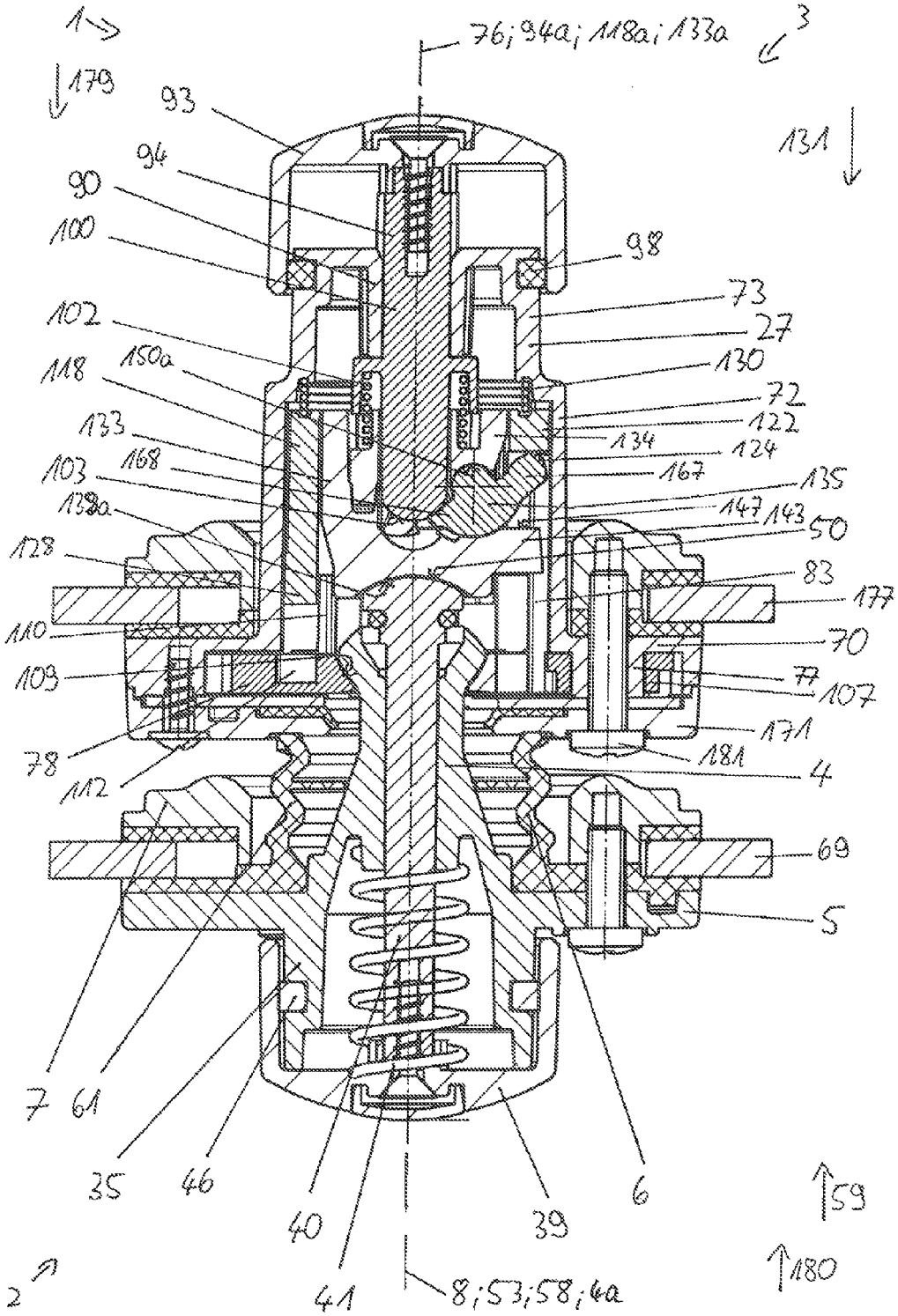
FIG. 3: shows a longitudinal section of an arrester according to the invention, in which a first pushbutton is actuated.

In the extended, actuated or pressed position, the first ram 40 and the first pushbutton 39 are displaced relative to the locking bolt 4 in the first pushbutton actuating direction 59 (FIG. 3). The ram head 47 protrudes out of the bolt head 12. The ram head 47 projects beyond the bolt head 12, seen in the first pushbutton actuating direction 59. In addition, the first pushbutton 39 sits on the inside together with the cap covering wall 44 on the sleeve end surface 37*a*. The sleeve end surface 37*a* therefore serves as an abutment for the movement of the first pushbutton 39 and of the ram 40, which is connected fixedly thereto, in the first pushbutton actuating direction 59. In addition, the pushbutton spring 41 is further compressed.

As already explained above, the male arrester part 2 also has a buffer 6, preferably made of elastically reversibly deformable material. In particular, the buffer 6 is composed of rubber (natural rubber) and/or of a thermoplastic elastomer (TPE), preferably of a thermoplastic elastomer vulcanized rubber (TPE-V). Furthermore, the buffer 6 has a buffer fastening plate 60 with a first fastening-plate surface 60*a* facing the locking bolt 4 and with a second fastening-plate surface 60*b* facing away from the locking bolt 4, and an expansion bellows 61. The two fastening-plate surfaces 60*a,b* are each preferably perpendicular to the locking bolt axis 4*a*. In addition, the second fastening-plate surface 60*b* bears in a sheet-like manner on the mounting-plate surface 28*a*.

The expansion bellows 61 has a folded bellows wall 62 which at least partially surrounds the locking bolt 4, wherein the bellows wall 62 is preferably arranged at a distance from the locking bolt 4. At least the bolt head 12 and the ram head 47 preferably protrude out of the expansion bellows 61. In addition, the bellows wall 62 protrudes from the first fastening-plate surface 60*a*. In addition, the expansion bellows 61 preferably has an annular disc 63 which is arranged within the bellows wall 62 and is integrally formed on the inside of the latter. The annular disc 63 likewise surrounds the locking bolt 4 and expediently bears in a sealing manner by the encircling annular opening edge thereof against the bolt outer surface 14, in particular against the third, conical bolt outer surface section 19. In addition, the buffer fastening plate 60 has a central bearing cutout 65. The buffer fastening plate 60 is arranged by means of the bearing cutout 65 around the buffer centering projection 30. The buffer 6, in particular the buffer fastening plate 60, is fixedly connected, in particular screwed, to the cover plate 7.

The cover plate 7 has a first cover-plate surface 7*a* and a second, preferably flat cover-plate surface 7*b* opposite the first cover-plate surface 7*a*. The first cover-plate surface 7*a* faces the pushbutton 39 and the second cover-plate surface 7*b* faces away from the pushbutton 39. Furthermore, the cover plate 7 has a sleeve-like, cylinder-tube-shaped annular extension 66 adjoining the second cover-plate surface 7*b* and a central cover plate cutout passing through the cover plate 7 in the direction of the actuating axis 8. The second cover-plate surface 7*b* is preferably of stepped design and has a rounded, encircling and protruding stop edge 68. The cover plate 7 is preferably composed of plastic.

In addition, the annular extension 66 of the cover plate 7 bears by means of the annular end edge thereof against the first fastening-plate surface 60*a*. This results in the formation between the second cover-plate surface 7*b* and the first fastening-plate surface 60*a* of a receiving gap in which a connecting plate 69 having a continuous cutout is arranged. The connecting plate 69 is, for example, part of the vehicle body or of a vehicle door. In addition, a spacer ring 178, for example made of rubber-elastic material, is preferably present between the connecting plate 69 and the second cover-plate surface 7*b*. In addition, the mounting plate 5, the buffer fastening plate 60 and the cover plate 7 are fixedly connected to one another and braced, in particular screwed, such that the connecting plate 69 is clamped between the first fastening-plate surface 60*a* and the cover plate 7.

In the installed state in the vehicle, the first pushbutton 39 also protrudes on one side of the connecting plate 69 beyond the latter in the direction of the first actuating axis 8, and the locking bolt 4 protrudes on the other side of the connecting plate 69 beyond the latter in the direction of the first actuating axis 8. If the male arrester part 2 is provided on the vehicle door, the first pushbutton 39 is arranged in such a manner that it can be actuated from an inside of the door. In this case, the locking bolt 4 protrudes outwards. If the male arrester part 2 is provided on the vehicle body, the first pushbutton 39 is arranged in such a manner that it can be actuated from the interior of the vehicle. In this case, the locking bolt 4 again protrudes outwards.

The female arrester part 3 (FIG. 1-5) has a housing 27, a rotary latch mechanism for receiving and for latching the locking bolt 4, a blocking element for locking the rotary latch mechanism in the position latching the locking bolt, and means for releasing the lock and preferably for ejecting the locking bolt 4 out of the female arrester part 3, and means for fastening the female arrester part 3 to the vehicle body or to the vehicle door.

The housing 27 (FIG. 1-4, 7-9) serves for receiving and mounting the individual parts of the female arrester part 3. For this purpose, the housing 27 has a housing plate 70, a housing border 71, a first housing sleeve 72, a second housing sleeve 73 and a housing covering wall 74. The housing 27 is preferably composed of plastic, in particular of PA 6 GF 30 (polyamide 6 with 30% glass fiber).

The housing plate 70 is preferably designed as an annular disc and has a first, preferably flat, housing-plate surface 70*a*, a second, preferably flat, housing-plate surface 70*b* and a central, continuous housing-plate cutout 75. A housing-plate cutout axis 75*a* is parallel to a second actuating axis 76 of the female arrester part 3. The housing plate 70 expediently has an extent perpendicular to the second actuating axis 76. As a consequence, the two housing-plate surfaces 70*a,b* are preferably perpendicular to the second actuating axis 76.

Furthermore, the housing plate 70 expediently has three mounting bushings 77 for the rotatable mounting of one rotary latch 78 each, wherein the rotary latches 78 are each mounted on the mounting bushings 77 so as to be rotatable and pivotable about a rotary-latch axis of rotation 79. In this case, the rotary-latch axes of rotation 79 are parallel to the second actuating axis 76, but are offset with respect thereto, i.e. are not coaxial with respect thereto. The mounting bushings 77 adjoin the first housing-plate surface 70*a* and protrude therefrom. In addition, the mounting bushings 77 are expediently distributed uniformly in the circumferential direction about the second actuating axis 76. The mounting bushings 77 preferably have a continuous bushing cutout through which screws 181 serving to fasten the female arrester part 3 to the vehicle body or to the vehicle door or vehicle hatch are guided.

In addition, the housing plate 70 expediently has three screw connection bushings 80 with a thread and three stop bushings 81 which likewise each adjoin the first housing-plate surface 70*a* and protrude therefrom. The three screw connection bushings 80 and the three stop bushings 81 are expediently distributed uniformly in the circumferential direction about the second actuating axis 76. Furthermore, the screw connection bushings 80 are preferably arranged in the vicinity of the housing border 71 and are connected thereto by means of a bar. As seen in the circumferential direction around the second actuating axis 76, each screw connection bushing 80 is arranged between two mounting bushings 77. In addition, one stop bushing 81 is arranged adjacent in the circumferential direction to each mounting bushing 77.

The housing border 71 adjoins the housing plate 70 on one side and protrudes from the first housing-plate surface 70*a* thereof. In addition, the housing border 71 is expediently of cylinder-tube-shaped design and has an outer, cylindrical or cylinder-jacket-shaped border circumferential surface 71*a* and a cylindrical or cylinder-jacket-shaped border inner surface 71*b*.

The first, preferably cylinder-tube-shaped, housing sleeve 72 adjoins the housing plate 70, in particular opposite the housing border 71, i.e. the second housing-plate surface 70*b*. In this case, a sleeve axis 82 of the first housing sleeve 72 is coaxial with respect to the second actuating axis 76. In addition, the first housing sleeve 72 has a cylinder-jacket-shaped sleeve outer surface 72*a* and a cylinder-jacket-shaped sleeve inner surface 72*b*. Furthermore, the first housing sleeve 72 has three guide rails 83 each having two rail tracks 84*a,b* which are parallel to each other and are each spaced apart from the other in the circumferential direction. The guide rails 83 adjoin the sleeve inner surface 72*b* and are preferably integrally formed thereon. In particular, the rail tracks 84*a,b* protrude substantially radially inwards from the sleeve inner surface 72*b*. In addition, the rail tracks 84*a,b* have a longitudinal extent parallel to the sleeve axis 82 and to the actuating axis 76. In addition, the three guide rails 83 are preferably distributed uniformly in the circumferential direction. The rail tracks 84*a,b* expediently extend from that end of the first housing sleeve 72 which faces the second housing sleeve 73 as far as the other end of the first housing sleeve 72 and preferably protrude beyond the second housing-plate surface 70*b*, as seen in a direction parallel to the sleeve axis 82. However, the rail tracks 84*a,b* do not extend beyond the housing border 71.

In addition, the first housing sleeve 72 expediently has three sliding strips 85 which are distributed uniformly in the circumferential direction and protrude slightly from the sleeve inner surface 72*b*. The sliding strips 85 have a longitudinal extent parallel to the sleeve axis 82 and preferably extend over the entire length of the first housing sleeve 72.

The second, preferably cylinder-tube-shaped, housing sleeve 73 adjoins the first housing sleeve 72 opposite the housing plate 70, as seen in a direction parallel to the second actuating axis 76. In this case, a sleeve axis 86 of the second housing sleeve 73 is coaxial with respect to the second actuating axis 76. In addition, the second housing sleeve 73 has a cylinder-jacket-shaped sleeve outer surface 73*a* and a cylinder-jacket-shaped sleeve inner surface 73*b*. In this case, the sleeve inner surface 73*b* of the second housing sleeve 73 has a smaller diameter than the sleeve inner surface 72*b* of the first housing sleeve 72. In addition, an annular stepped shoulder having a shoulder surface 87*a* in the shape of a circular ring and a stepped circumferential surface 87*b* which is conical or cone-shaped and tapers towards the second housing sleeve 73 is present between the two sleeve inner surfaces 72*b*, 73*b*. The diameter of the stepped circumferential surface 87*b* is smaller here than the diameter of the sleeve inner surface 72*b* of the first housing sleeve 72 but larger than the diameter of the sleeve inner surface 73*b* of the second housing sleeve 73. The stepped circumferential surface 87*b* merges via a second shoulder surface 87*c* in the shape of a circular ring into the sleeve inner surface 73*b* of the second housing sleeve 73, with an annular groove 87*d* being provided in the second shoulder surface 87*c*.

In addition, a further encircling annular groove 88 is provided in the sleeve outer surface 73*a* of the second housing sleeve 73. The annular groove 88 is arranged at the free end of the second housing sleeve 73, which end faces away from the first housing sleeve 72.

The housing covering wall 74 of the housing 27 has a covering-wall outer surface 74*a* and a covering-wall inner surface 74*b* opposite the latter. In addition, the housing covering wall 74 adjoins the second housing sleeve 73 at the free end of the second housing sleeve 73, which end faces away from the first housing sleeve 72, and covers said second housing sleeve 73. The housing covering wall 74 also has a continuous covering wall cutout 89, the covering-wall cutout axis 89*a* of which is coaxial with respect to the second actuating axis 76.

A guide bushing 90 of the housing 27 adjoins the covering-wall inner surface 74*b*. In this case, the tubular guide bushing 90 has a guide bushing axis 91 which is coaxial with respect to the second actuating axis 76. In addition, the guide bushing 90 has a guide-bushing outer surface 90*a* and a guide-bushing inner surface 90*b*. The cross-sectional shape of the two guide bushing surfaces 90*a,b*, in particular that of the guide-bushing inner surface 90*b*, deviates here from a circular-cylindrical shape. The guide-bushing inner surface 90*b* preferably has an edge profile, for example with four rounded edges. At the free end thereof facing away from the housing covering wall 74, the guide bushing 90 has an encircling, annular, preferably flat, stop surface 92.

In order to release the latching or locking of the rotary latch mechanism and therefore of the locking bolt 4, the female arrester part 3 likewise has a pushbutton mechanism. The second pushbutton mechanism of the female arrester part 3 has a second cap-shaped or hood-shaped pushbutton 93 and a second ram 94. The pushbutton 93 has a, preferably cylinder-jacket-shaped, cap side wall 95 with a cylindrical or cylinder-jacket-shaped side-wall inner surface 95*a* and a cap covering wall 96. In this case, a cylinder axis of the side-wall inner surface 95*a* is preferably coaxial with respect to the second actuating axis 76. In addition, the pushbutton 93 is preferably formed rotationally symmetrically to the second actuating axis 76. A plug-in sleeve 97 is integrally formed on the inside of the cap covering wall 96. The plug-in sleeve 97 is arranged centrally with respect to the extent of the cap covering wall 96. The second pushbutton 93 is mounted on the second housing sleeve 73 so as to be displaceable to and fro in the direction of the second actuating axis 76. The second pushbutton 93 is therefore mounted so as to be displaceable to and fro with respect to the housing 27 in the direction of the second actuating axis 76. For this purpose, the second pushbutton 93 is arranged with the side-wall inner surface 95*a* thereof around the sleeve outer surface 73*a* of the second housing sleeve 73. In addition, a sealing ring 98 is arranged in the annular groove 88, wherein the side-wall inner surface 95*a* bears against the sealing ring 98 and is guided thereon.

The second ram 94 has a longitudinal extent in the direction of a ram longitudinal axis 94*a* which is coaxial with respect to the second actuating axis 76. Furthermore, the ram 94 is preferably composed of plastic, in particular of PBT-GF30 (polybutyleneterephthalate with 30% glass fiber).

In addition, the ram 94 has a cylindrical ram pin 99, an elongate ram-guiding section 100 adjoining the ram pin 99, and a receiving cap 101 for receiving, guiding and supporting a pushbutton spring 102. At the end thereof which faces away from the ram-guiding section 100, the ram pin 99 has a rounded actuating surface 103 in the manner of a dome or in the manner of a segment of a spherical surface. The ram-guiding section 100 has a cross-sectional shape corresponding to the cross-sectional shape of the guide-bushing inner surface 90*b*. The receiving cap 101 has a sleeve-like or tubular receiving-cap side wall 104 and a receiving-cap covering wall 105 in the shape of an annular disc. The receiving-cap side wall 104 has a preferably conical or cone-shaped side-wall inner surface 104*a* tapering towards the receiving-cap covering wall 105 and a preferably cylindrical or cylinder-jacket-shaped side-wall outer surface 104*b*. The receiving-cap covering wall 105 has a preferably planar covering inner surface 105*a* and a preferably planar covering outer surface 105*b* opposite the latter. The receiving-cap covering wall 105 is arranged in the transition region of the ram pin 99 and ram-guiding section 100 and extends substantially perpendicularly to the ram longitudinal axis 94*a* and to the second actuating axis 76. The receiving-cap side wall 104 is arranged around the ram pin 99 and therefore extends away from the receiving-cap covering wall 105 towards the actuating surface 103. In this case, the ram pin 99 protrudes partially out of the receiving cap 101, in particular out of the receiving-cap side wall 104.

The second ram 94 is connected fixedly, i.e. nonrotatably and nondisplaceably, but preferably releasably, to the second pushbutton 93. In particular, at the end thereof facing away from the ram pin 99, the ram-guiding section 100 is connected to the cap covering wall 96 of the second pushbutton 93. A ram plug-in pin 106 is preferably plugged into the plug-in sleeve 97, and the ram-guiding section 100 and the cap covering wall 96 are screwed to each other. Furthermore, the ram 94 is guided by means of the ram-guiding section 100 thereof in the guide bushing 90 so as to be displaceable to and fro in the direction of the second actuating longitudinal axis 76 and otherwise so as to be nonrotatable. In particular, the ram-guiding section 100 is guided in the guide bushing 90 in a form-fitting manner.

The second ram 94 and the second pushbutton 93 are therefore displaceable relative to the housing 27 by a limited amount in the direction of the second actuating longitudinal axis 76. In particular, the second ram 94 and the second pushbutton 93 can be displaced from an unactuated starting position into an actuated, pressed position. In the unactuated position (FIG. 1-3), the second ram 94 bears with the covering outer surface 105*b* of the receiving-cap covering wall 105 against the stop surface 92 of the guide bushing 90. The covering outer surface 105*b* is therefore an abutment for the movement of the second ram 94 and of the second pushbutton 93 counter to a second pushbutton actuating direction 179. In the closed state of the door arrester 1, the second pushbutton actuating direction 179 is parallel to the second actuating longitudinal axis 76 (FIG. 2) and opposed to the first pushbutton actuating direction 59.

As already explained above, the female arrester part 3 also has a rotary latch mechanism with at least two, preferably three, rotatably mounted rotary latches 78 for latching and enclosing the locking bolt 4. The rotary latches 78 are preferably of substantially plate-like design and have a first rotary-latch surface 78*a* and a second rotary-latch surface 78*b* which is opposite the latter, and an encircling rotary-latch circumferential edge 78*c*. The plate-like rotary latches 78 preferably extend perpendicularly to the second actuating axis 76. In addition, the rotary latches 78 each have a rotary-latch bearing section 107 with a rotary-latch bearing cutout 108 passing through continuously from the first rotary-latch surface 78*a* to the second rotary-latch surface 78*b*. The rotary-latch bearing cutout 108 is expediently of cylinder-jacket-shaped design. The three rotary latches 78 are preferably of identical design, i.e. have an identical spatial shape.

In addition, the rotary latches 78 are preferably composed of plastic, in particular of POM-GF25 (polyoxymethylene with 25% glass fiber).

In addition, the rotary latches 78 each have an arcuate locking-bolt-enclosing surface 109. The locking-bolt-enclosing surface 109 is preferably part of the rotary-latch circumferential edge 78*c*. The arcuate locking-bolt-enclosing surface 109 is expediently designed in the form of a section of a spherical surface or in the manner of a dome. In particular, the locking-bolt-enclosing surface 109 has an arcuate profile about an axis parallel to the second actuating axis 76. The locking-bolt-enclosing surface 109 expediently extends from the first rotary-latch surface 78*a* to the second rotary-latch surface 78*b*, wherein said locking-bolt-enclosing surface widens with respect to the second rotary-latch surface 78*b*. In particular, the locking-bolt-enclosing surface 109 extends from a first locking-bolt-enclosing edge 109*a* to a second locking-bolt-enclosing edge 109*b*. The first locking-bolt-enclosing edge 109*a* bounds the locking-bolt-enclosing surface 109 on the first rotary-latch surface 78*a*, and the second locking-bolt-enclosing edge 109*b* bounds the locking-bolt-enclosing surface 109 on the second rotary-latch surface 78*b*. The locking-bolt-enclosing surface 109 widens from the first locking-bolt-enclosing edge 109*a* towards the second locking-bolt-enclosing edge 109*b*. That is to say, the first locking-bolt-enclosing edge 109*a* has a greater curvature than the second locking-bolt-enclosing edge 109*b*, in each case as seen about an axis parallel to the second actuating axis 76.

The radius of the first locking-bolt-enclosing edge 109*a* preferably corresponds here to the radius of the cylindrical bolt outer-surface section 18. The radius of the second locking-bolt-enclosing edge 109*b* is greater than the radius of the first locking-bolt-enclosing edge 109*a*. In particular, the radius of the second locking-bolt-enclosing edge 109*b* corresponds to the radius of the bolt head edge 17. In addition, the shape of the locking-bolt-enclosing surface 109 preferably corresponds to the shape of the conical bolt outer-surface section 16.

The rotary latches 78 also each have a blocking lug 110. The blocking lug 110 protrudes substantially vertically from the second rotary-latch surface 78*b*. In addition, the blocking lug 110 is expediently arranged adjacent to the locking-bolt-enclosing surface 109, in particular at one end thereof. The blocking lug 110 has a sliding surface 111*a* which faces the locking-bolt-enclosing surface 109. The sliding surface 111*a* is expediently designed initially, as seen starting from the second rotary-latch surface 78*b*, in the shape of a segment of a cylinder jacket and then tapers such that the free end of the blocking lug 110 is of wedge-shaped design. With the sliding surface 111*a*, the blocking lug 110 preferably directly adjoins the second locking-bolt-enclosing edge 109*b*. In the region thereof which is in the shape of a segment of a cylinder jacket, the sliding surface 111*a* expediently has the same curvature as the second locking-bolt-enclosing edge 109*b*. Opposite the sliding surface 111*a*, the blocking lug 110 has a lug surface 111*b* preferably designed in the shape of a segment of a cylinder jacket.

Furthermore, the rotary latches 78 each have a blocking trough 112. The blocking trough 112 is designed as a depression in the second rotary-latch surface 78*b* and has a trough base 112*a* and an encircling trough edge 112*b*. In addition, the blocking trough 112 is preferably arranged adjacent to the locking-bolt-enclosing surface 109 and to the blocking lug 110. Moreover, further depressions are preferably provided in the second rotary-latch surface 78*b*, said depression serving to reduce the weight.

Furthermore, the rotary latches 78 each have two hook projections 113, 114, each serving to fasten a rotary-latch spring 115, which will be discussed in more detail further below.

The rotary latches 78 also each have a stop lug 116. The stop lug 116 has a lug rear wall 116*a*. The stop lug 116 is preferably arranged opposite the rotary-latch bearing section 107. In addition, a depression 182 serving to save on material is expediently formed in each case in the rotary-latch circumferential edge 78*c* adjacent to the stop lug 116.

In the installed state, the rotary latches 78 are each mounted rotatably by the rotary-latch bearing cutouts 108 thereof on the mounting bushings 77. In this case, the second rotary-latch surfaces 78*b* each face the first housing-plate surface 70*a*. In particular, the second rotary-latch surfaces 78*b* each bear slidably against the first housing-plate surface 70*a*. The blocking lugs 110 protrude into the first housing sleeve 72, the sliding surface 111*a* facing the second actuating axis 76. In addition, the rotary latches 78 are arranged in such a manner that the locking-bolt-enclosing surfaces 109 thereof are distributed around the second actuating axis 76 and face each other such that they can enclose and latch the locking bolt 4. In addition, the rotary latches 78 are mounted so as to be rotatable to and fro to a limited extent about the rotary-latch axes of rotation 79. In this case, the rotary latch springs 115 are arranged so as to press the rotary latches 78 against each other by the locking-bolt-enclosing surfaces 109 thereof. The rotary latches 78 are therefore connected to one rotary latch spring 115 each so as to be drivable in a rotary-latch-closing direction 117. For this purpose, the rotary latch springs 115, which are preferably leg springs, are supported at one end on a respective rotary latch 78 and at the other end on the housing 27, in particular the housing border 71. In addition, a respective screw connection bushing 80 is arranged in the region of a depression 182 and a respective stop lug 116 is arranged with the lug rear wall 116*a* thereof adjacent to one of the stop bushings 81.

In this case, the locking-bolt-enclosing surfaces 109 of the rotary latches 78 pivot towards each other upon rotation of the rotary latches 78 in the rotary-latch-closing direction 117. When the rotary latches 78 are rotated counter to the rotary-latch-closing direction 117, the locking-bolt-enclosing surfaces 109 of the three rotary latches 78 pivot away from one another. The movement of the rotary latches 78 in the rotary-latch-closing direction 117 is limited to a maximum by the rotary latches 78 each striking by the lug rear wall 116*a* of the stop lug 116 thereof against the respective stop bushing 81. The stop bushings 81 can therefore serve as abutments for the movement of the rotary latches 78 in the rotary-latch-closing direction 117.

In addition, the female arrester part 3 has a cover plate 171 which covers the housing plate 70. An intermediate plate 172 is expediently provided between the housing plate 70 and the cover plate 171. Both the cover plate 171 and the intermediate plate 172 have a continuous cutout for the passage of the locking bolt 4. In addition, there is an annular disc 173 made of rubber-elastic material, which is arranged, in particular clamped, between the intermediate plate 172 and the cover plate 171 and which prevents dirt from penetrating the female arrester part 3. The housing plate 70, the intermediate plate 172 and the cover plate 171 are fixedly connected, in particular screwed, to one another.

In addition, the latching and/or locking mechanism has, as blocking element, a blocking bushing 118 which can interact with the rotary latches 78 in a manner latching the locking bolt 4. In particular, the blocking bushing 118 can lock the rotary latches 78 in the position thereof latching and enclosing the locking bolt 4. The tubular blocking bushing 118 has a bushing wall 119 with a bushing outer surface 120*a*, a bushing inner surface 120*b*, a first bushing border 121*a* and a second bushing border 121*b*. In addition, the blocking bushing 118 has a blocking bushing axis 118*a* which is preferably parallel to, in particular coaxial with respect to, the second actuating axis 76.

In addition, the blocking bushing 118 has three guide lugs 122 which serve for guiding and mounting the blocking bushing 118 in the first housing sleeve 72. The guide lugs 122 are distributed uniformly in the circumferential direction of the blocking bushing 118. Moreover, the guide lugs 122 protrude outwards over the bushing outer surface 120*a* in the radial direction or in a direction perpendicular to the blocking bushing axis 118*a*. Furthermore, the guide lugs 122 are arranged on the second bushing border 121*b* or adjacent thereto. They have two lateral, flat lug-guiding surfaces, an outer lug-guiding surface 129 and a preferably likewise flat lug-supporting surface 124. The lug-supporting surface 124 is arranged at that end of a guide lug 122 which faces away from the second bushing border 121*b*. Guide strips 125 are arranged adjacent to a guide lug 122 on both sides. The guide strips 125 have a longitudinal extent in a direction parallel to the blocking bushing axis 118*a*. In addition, the guide strips 125 each have a strip-guiding surface 125*a*, wherein the strip-guiding surfaces 125*a* of the two guide strips 125 belonging to each other face each other and the respective guide lug 122. Furthermore, the bushing wall 119 has three slots 126 extending in a direction parallel to the blocking bushing axis 118*a*. The slots 126 extend from the first bushing border 121*a* into the bushing wall 119 and end in each case level with a lug-supporting surface 124. A slot end edge 126*a* is therefore arranged adjacent to and coplanar with respect to a respective lug-supporting surface 124, and therefore the slot end edge 126*a* and the lug-supporting surface 124 form a uniform, continuous surface. In addition, the slots 126 are each arranged between two guide strips 125 belonging to each other.

In addition, the blocking bushing 118 has at least two, preferably three, locking lugs 128 which are likewise distributed uniformly in the circumferential direction of the blocking bushing 118. The locking lugs 128 also each protrude over the first bushing border 121*a* in a direction parallel to the blocking bushing axis 118*a*. The locking lugs 128 are expediently offset with respect to the guiding lugs 122, as seen in the circumferential direction.

In addition, the blocking bushing 118 has three recesses 123 which are each provided in the bushing wall 119 in the region of the bushing inner surface 120*b*. The recesses 123 are each arranged between a locking lug 128 and a guiding strip 125, as seen in the circumferential direction. In addition, the recesses 123 extend from the first bushing border 121*a* into the bushing wall 119.

In addition, a gap 127 is formed between in each case one guiding strip 125 and one locking lug 128, in which gap the first bushing border 121*a* is offset towards the second bushing border 121*b*.

In addition, an encircling annular groove 132 is expediently provided in the second bushing border 121*b*.

The blocking bushing 118 is preferably composed of plastic, preferably of POM (polyoxymethylene).

Furthermore, the blocking bushing 118 is mounted in the second housing sleeve 23 so as to be displaceable to and fro by a limited amount in a direction parallel to the second actuating axis 76 and otherwise to be nonrotatable. For this purpose, the guiding lugs 122 are each guided in a sliding manner between two rail tracks 84*a,b* of a guide rail 83. In addition, the two rail tracks 84*a,b* of a guide rail 83 are each guided in a sliding manner between two guiding strips 125 and the outer lug-guiding surfaces 129 are guided in a sliding manner on the sleeve inner surface 72*b* of the first housing sleeve 72. In this case, the blocking bushing 118 is arranged in such a manner that the second bushing border 121*b* faces the second pushbutton 93 and the first bushing border 121*a* faces the rotary latches 78. In particular, the locking lugs 128 face the rotary latches 78.

Furthermore, there is a blocking bushing spring 130 which presses the blocking bushing 118 onto the rotary latches 78. The blocking bushing spring 130 is supported at one end on the second bushing border 121*b* and at the other end in the annular groove 87*d* of the second shoulder surface 87*c*. In particular, the blocking bushing spring 130 is arranged at one end in the annular groove 132 of the second bushing border 121*b*. The blocking bushing 118 is connected to the blocking bushing spring 130 so as to be drivable in a blocking-bushing-latching direction 131 parallel to the second actuating axis 76. The blocking bushing spring 130 presses the blocking bushing 118 in to the latching and locking position thereof.

In addition, the blocking bushing 118 can be driven counter to the blocking-bushing-latching direction 131 by means of the first and by means of the second pushbutton mechanism, which will be discussed in more detail further below.

In addition, a stopper or plug 133, a bearing ring 134 and at least two, preferably three, driving levers 135 are mounted in the blocking bushing 118.

The stopper 133 (FIG. 1-4, 7, 16-18) is expediently of hood-like design and has a stopper base wall 136 and an adjoining stopper side wall 137. The encircling stopper side wall 137 is therefore covered at one end by the stopper side wall 137 and is open at the other end. In addition, there is a stopper longitudinal centre axis 133*a* which is expediently coaxial with respect to the second actuating axis 76. The stopper base wall 136 has an outer stopper base surface 138. The stopper base surface 138 expediently has a central stopper actuating surface 138*a* which is preferably designed to be concave or to curve inwards. In particular, the stopper actuating surface 138*a* is curved in the manner of a dome or in the manner of a spherical surface. The curvature of the contour of the stopper actuating surface 138*a* corresponds in particular to the curvature of the contour of the surface formed by the head surface 50 of the first ram 40 and by the actuating surface 15 of the locking bolt 4 in the retracted position of the first ram 40. The stopper actuating surface 138*a* is preferably surrounded by a planar stopper-base annular surface 138*b* in the shape of a circular ring.

In addition, the stopper side wall 137 is of slotted design and has three reach-through slots 146 extending in a direction parallel to the stopper longitudinal centre axis 133*a*. The three reach-through slots 146 are preferably spaced apart uniformly from one another in the circumferential direction with respect to the stopper side wall 137. The reach-through slots 146 extend from the free end of the stopper side wall 137 into the stopper side wall 137 as far as the stopper base wall 136. The reach-through slots 146 divide the stopper side wall 137 into three stopper side-wall segments 145. The three stopper side-wall segments 145 are arranged around the stopper longitudinal centre axis 133*a* and so as to be spaced apart uniformly from one another. In addition, the stopper side-wall segments 145 are substantially designed in the shape of a segment of a cylinder tube. A stopper side-wall segment 145 in each case has a preferably flat segment edge 144 which is provided at that free end of the stopper side-wall segment 145 which faces away from the stopper base wall 136. The stopper side-wall segments 145 each have a central segment inner surface 140 in the shape of a segment of a cylinder jacket.

Both sides of the segment inner surface 140 are adjoined by edge surfaces 141 which extend substantially radially with respect to the stopper longitudinal centre axis 133*a* and parallel to the stopper longitudinal centre axis 133*a*. The edge surfaces 141 are each adjoined by surfaces 142 extending parallel to the stopper longitudinal centre axis 133*a* and substantially in the circumferential direction with respect to the stopper longitudinal centre axis 133*a*. The surfaces 142 are offset radially outwards with respect to the segment inner surface 140.

Furthermore, the stopper 133 has a side-wall outer surface 139 which adjoins the stopper base surface 138. The side-wall outer surface 139 first of all has a first, cylinder-jacket-shaped section 139*a*, as seen from the stopper base wall 136 and as seen in a direction parallel to the stopper longitudinal centre axis 133*a*. The stopper-base annular surface 138*b* and the first cylinder-jacket-shaped section 139*a* merge into each other via a circular stopper sliding edge 138*c*. The first cylinder-jacket-shaped section 139*a* is adjoined by a conical or cone-shaped section 139*b*. The conical section 139*b* widens away from the first cylinder-jacket-shaped section 139*a* towards a second cylinder-jacket-shaped section 139*c*. The second cylinder-jacket-shaped section 139*c*, which is interrupted by the reach-through slots 146, ends at the stopper border 144. The sections 139*a*, 139*b*, 139*c* are preferably formed rotationally symmetrically with respect to the stopper centre longitudinal axis 133*a*.

In this case, the radius of the stopper sliding edge 138*c* and of the first cylinder-jacket-shaped section 139*a* preferably corresponds to the radius of the bolt head edge 17. The radius of the first cylinder-jacket-shaped section 139*a* is therefore greater than the radius of the cylindrical bolt outer-surface section 18.

In addition, the stopper 133 has three protruding guiding lugs 143 which are preferably distributed uniformly around the stopper longitudinal centre axis 133*a*. The guiding lugs 143 are each arranged at the base-wall end of a reach-through slot 146 and protrude from the side-wall outer surface 139 of the stopper 133 substantially in the radial direction with respect to the stopper longitudinal centre axis 133*a*. The guiding lugs 143 serve for the sliding mounting of the stopper 133 in the blocking bushing 118, which is explained in more detail further below. The guiding lugs 143 are expediently of cuboidal design and each have a preferably planar supporting surface 147 facing the free end of the side wall segments 145 or the respective guide slot 146. The supporting surfaces 147 are preferably perpendicular to the stopper longitudinal centre axis 133*a*.

In addition, the stopper 133 has three bases 148 which adjoin the inside of the stopper base wall 136 and one segment inner surface 140 each and protrude away or inwards therefrom. Each base 148 has a plug-in hole 149.

In addition, the stopper 133 has three pairs of in each case two opposite, first bearing shell segments 150*a,b*. The first bearing shell segments 150*a,b* are each in the shape of a segment of a cylinder jacket. In addition, two first bearing shell segments 150*a,b* are each arranged with respect to the bearing-shell cylinder axes 151*a,b* thereof coaxially with respect to each other and are arranged opposite each other, wherein the bearing-shell cylinder axes 151*a,b* are each perpendicular to the stopper centre longitudinal axis 133*a*. The two first bearing shell segments 150*a,b* of a pair are in each case spaced apart from each other by a reach-through slot 146. That is to say, the two first bearing shell segments 150*a,b* of a pair are arranged on both sides of a reach-through slot 146. In addition, the first bearing shell segments 150*a,b* are each arranged slightly above the stopper base wall 136 and are molded into the side wall segments 145 and the bases 148.

Centrally and on the inside, the stopper base wall 136 preferably has a trough 152, preferably in the manner of a segment of a spherical surface.

The bearing ring 134 (FIG. 1-4, 7, 19-21) has a ring wall 153, a sleeve extension 154, three blocks 155, three plug-in pins 156 and three second bearing shell segments 157 and a bearing ring axis 134*a*. The preferably cylinder-tube-shaped ring wall 153 has a first ring surface 153*a* and a second ring surface 153*b* opposite the latter. The three plug-in pins 156 are integrally formed on the first ring surface 153*a*. The second ring surface 153*b* is adjoined by the sleeve extension 154. A bearing ring cutout 158 extends through the sleeve extension 154 and the ring wall 153. The blocks 155 adjoin a cylinder-jacket-shaped ring outer surface 159 of the ring wall 153. The blocks 155 are expediently distributed uniformly about the bearing ring axis 134*a*. In addition, the blocks 155 are arranged around the sleeve extension 154 and each have a, preferably cylinder-jacket-shaped, block inner surface 155*a* and a, preferably cylinder-jacket-shaped, block outer surface 155*b*. A protruding lug 160 having an oblique stop surface 161 is integrally formed in each case on the block outer surface 155*b*. The lug 160 extends over the entire block 155 in each case, as seen in the direction of the stopper longitudinal centre axis 133*a*. In addition, the lug 160 is arranged centrally with respect to the respective block, as seen in the circumferential direction. The stop surface 161 is preferably of wedge-shaped design and tapers from the second ring surface 153*b* towards the first ring surface 153*a*.

The second bearing shell segments 157 are designed in the shape of a segment of a cylinder jacket analogously to the first bearing shell segments 150*a,b* and each have a bearing-shell cylinder axis 162, wherein the bearing-shell cylinder axes 162 are perpendicular to the bearing ring axis 134*a* and two bearing-shell cylinder axes 162 which are adjacent to each other in the circumferential direction expediently enclose an angle of 60° in each case with each other. The second bearing shell segments 157 are molded into the first ring surface 153*a* and the blocks 155.

The three driving levers 135 (FIG. 1-4, 7, 22, 23) each have a bearing shaft or bearing roll or bearing roller 163 and a lever body 164. The cylindrical bearing shaft 163 has a shaft axis 163*a*. The lever body 164 which is of elongate design has two opposite lever side surfaces 165 and an encircling lever circumferential edge 166. In this case, two bearing shaft ends 170 of the bearing shaft 163 protrude over the lever side surfaces 165 on both sides in the direction of the shaft axis 163*a*. In addition, the bearing shaft 163 is expediently integrally formed on the lever circumferential edge 166. In addition, the lever body 164 has a supporting lug 167 at one end. At the other end, an actuating lug 168 with an actuating surface 168*a* which is part of the lever circumferential edge 166 is provided. In addition, there is an actuate rolling surface 169 which extends from the actuating lug 168 to the supporting lug 167 and which is expediently arranged opposite the bearing shaft 163.

In the assembled state (FIG. 1-4), the bearing ring 134 is plugged into the stopper 133 in such a manner that the blocks 155 are arranged in one reach-through slot 146 each and are held in a form-fitting manner between in each case two edge surfaces 141 of two mutually adjacent side wall segments 145. In particular, the lugs 160 are arranged in one reach-through slot 146 each. In addition, the blocks 155 preferably end flush with the side wall segments 145 at the free ends thereof. As a result, the reach-through slots 146 are bounded or sealed by the blocks 155.

The bearing ring 134 is pushed in until the plug-in pins 156 are plugged into the plug-in holes 149 in a form-fitting and clamping manner. In addition, a second bearing shell segment 157*b* is arranged opposite two first bearing shell segments 150*a,b* of a pair of first bearing shell segments 150*a,b* such that the respective bearing-shell cylinder axes 151*a,b*; 162 are coaxial with respect to each other. The first and second bearing shell segments 150*a,b*, 157 therefore each form two bearing shells. The bearing ring 134 and the stopper 133 are therefore connected fixedly to each other, i.e. nondisplaceably and nonrotatably, but preferably releasably. In particular, there is a clamping connection between the stopper 133 and the bearing ring 134.

The driving levers 135 are mounted in the unit consisting of the stopper 133 and bearing ring 134 so as to be rotatable in each case about the shaft axis 163*a* thereof. In particular, one bearing shaft end 170 is mounted rotatably on one of the two first bearing shell segments 150*a,b* of a pair of first bearing shell segments 150*a,b* and the opposite second bearing shell element 157. In this case, the supporting lugs 167 protrude out of the stopper 133 through the reach-through slots 146 in the radial direction with respect to the stopper longitudinal centre axis 133*a*. In the unactuated state, the supporting lugs 167 rest on the supporting surfaces 147. The rolling surfaces 169 are arranged facing the stopper base wall 136. In addition, the lever bodies 164 protrude in each case by means of the actuating lug 168 thereof into the centre of the stopper 133. In particular, the actuating lugs 168 rise above the trough 152. In this case, the actuating surfaces 168*a* are directed away from the stopper base wall 136.

The unit thus formed, consisting of the stopper 133, bearing ring 134 and driving levers 135, is mounted in the blocking bushing 118 so as to be displaceable to and fro by a limited amount in a direction parallel to the second actuating axis 76. In particular, each guiding lug 143 of the stopper 133 is guided in a sliding manner in a respective slot 126 of the blocking bushing 118. In this case, the supporting lugs 167 of the driving levers 135 also reach through the respective slot 126 of the blocking bushing 118. The supporting lugs 167 here are each arranged between a guiding lug 143 of the stopper 133 and a guiding lug 122 of the blocking bushing 118. The stopper actuating surface 138*a* faces away from the ram 94. The second ring surface 153*b* and the sleeve extension 154 face the second ram 94 and the second pushbutton 93. In addition, the second ram 94 is arranged, as seen in a direction parallel to the second actuating axis 76, in alignment with the bearing ring cutout 158 and above the actuating surfaces 168*a* of the actuating lugs 168 of the driving levers 135. As already explained above, the second pushbutton spring 102 is supported at one end on the receiving cap 101 of the second ram 94. At the other end, the second pushbutton spring 102 is supported on the second ring surface 153*b* of the bearing ring 134. For this purpose, the second pushbutton spring 102 is arranged around the sleeve extension 154 and therefore between the sleeve extension 154 and the blocks 155 or the side wall segments 145. The pushbutton spring 102 drives the unit consisting of the stopper 133, bearing ring 134 and driving levers 135 in the blocking-bushing latching direction 131. That is to say, the pushbutton spring 102 presses the unit consisting of the stopper 133, bearing ring 134 and driving levers 135 out of the blocking bushing 118 and in particular out of the housing 27. The movement of the unit consisting of the stopper 133, bearing ring 134 and driving levers 135 in the blocking-bushing latching direction 131 is limited by the guiding lugs 143 of the stopper 133 bearing or striking against the intermediate plate 172.

In order to fasten the female arrester part 3 to the vehicle body or to the vehicle door, the arrester part 3 has a screw connection plate 174 and two washers 175, 176, preferably made of rubber-elastic material. A vehicle plate 177 which is part of the body of the particular vehicle or vehicle door is arranged between the screw connection plate 174 and the housing plate 70, opposite the cover plate 171, wherein there are respective washers 175, 176 between the screw connection plate 174 and the vehicle plate 177 and between the housing plate 70 and the vehicle plate 177. The vehicle plate 177 here has a continuous cutout through which the first housing sleeve 72 penetrates. The screw connection plate 174, the two washers 175, 176, the vehicle plate 177, the housing plate 70, the intermediate plate 172 and the cover plate 171 are expediently screwed to one another.

In the fitted state in the vehicle, the second pushbutton 93 also protrudes beyond the vehicle plate 177 on one side of the vehicle plate 177 in the direction of the second actuating axis 76, and the stopper 133 is accessible from the other side of the vehicle plate 177. If the female arrester part 3 is provided on the vehicle door, the second pushbutton 93 is arranged in such a manner that it can be actuated from an inside of the door. In this case, the stopper 133 is accessible from the outside of the door. If the female arrester part 3 is provided on the vehicle body, the second pushbutton 93 is arranged in such a manner that it can be actuated from the vehicle interior. In this case, the stopper 133 is accessible from the exterior of the vehicle.

The functioning of the door arrester 1 according to the invention is explained in more detail below:

If the vehicle door is still closed, the male and female arrester parts 2, 3 are in their respective starting positions (FIG. 1) in which they are not operatively connected to each other. That is to say, the two pushbuttons 39, 93 are unactuated and the two rams 40, 94 are in the retracted position thereof. In addition, the unit consisting of the stopper 133, bearing ring 134 and driving levers 135 is pressed by the pushbutton spring 102 into the starting position of said unit, in which the guiding lugs 143 of the stopper 133 bear against the intermediate plate 172. As a result, the stopper 133 protrudes somewhat out of the housing 27. In addition, the stopper base surface is arranged on the cutout of the cover plate 171, and therefore the stopper base surface 138 is freely accessible.

The driving levers 135 are likewise in the unactuated position thereof. In addition, the second pushbutton spring 102 presses the second ram 94 and, via the latter, the second pushbutton 93 into the unactuated position. The disc 173 bears in a sealing manner against the outside of the stopper base wall 136.

The rotary latches 78 are pressed towards each other by the locking-bolt-enclosing surfaces 109 thereof by means of the rotary latch springs 115. In this case, the first locking-bolt-enclosing edges 109*a* are each pressed against the side-wall outer surface 139 of the stopper 133, in particular in the region of the transition from the cone-shaped section 139*b* to the first cylinder-jacket-shaped section 139*a*. The stopper 133 therefore serves as an abutment for the rotational movement of the rotary latches 78 in the rotary-latch-closing direction 117.

The blocking bushing 118 is pressed towards the rotary latches 78 by the force of the blocking bushing spring 130. In particular, in each case one of the three locking lugs 128 is pressed against the second rotary-latch surface 78*b* of one of the three rotary latches 78. However, in the process, the three rotary latches 78 are rotated with respect to the blocking bushing 118 and therefore the locking lugs 128 in such a manner that the locking lugs 128 cannot engage in the blocking troughs 112. In addition, the blocking lugs 110 of the rotary latches 78 are arranged adjacent to the second cylinder-jacket-shaped section 139*c* of the side-wall outer surface 139 of the stopper 133 and surround the latter. The blocking lugs 110 of the rotary latches 78 are expediently also arranged, as seen in a direction parallel to the second actuating axis 76, aligned with the first bushing border 121*a* of the blocking bushing 118, in the gap 127 between one locking lug 128 and one guiding strip 125 in each case.

When the respective vehicle door is closed, the locking bolt 4 is now inserted in an insertion direction 180 through the cutout in the cover plate 171 into the female arrester part 3. The insertion direction 180 is parallel to the locking bolt axis 4*a* and preferably to the first and second actuating axes 8, 76. In addition, the insertion direction 180 is in the same direction as the first pushbutton-actuating direction 59.

Upon insertion, the bolt head 12 and the ram head 47 of the first ram 40 come into engagement by means of the actuating surface 15 and the head surface 50 with the stopper-actuating surface 138*a*. As the locking bolt 4 continues to be inserted, the unit consisting of the stopper 133, bearing ring 134 and driving levers 135 is displaced towards the second ram 94 in the insertion direction 180 into the interior of the female arrester part 3 by the pressure applied to the stopper-actuating surface 138*a*. In the process, the second pushbutton spring 102 is compressed.

In addition, the stopper 133 slides in the blocking bushing 118, i.e. moves in the insertion direction 180 relative to the blocking bushing 118, counter to the blocking-bushing-latching direction 131. In particular, the guiding lugs 143 of the stopper 133 and the supporting lugs 167 slide in the slots 126 of the blocking bushing 118, where they move towards the slot end edges 126*a* and the guiding lugs 122 of the blocking bushing 118. In the closed position (FIG. 2), the stopper 133 is displaced until the supporting lugs 167 bear against the slot end edges 126*a* and the respective lug-supporting surfaces 124.

Upon displacement of the stopper 133 into the interior of the female arrester part 3, the first locking-bolt-enclosing edges 109*a* first of all also slide in the direction of the stopper-sliding edge 138*c* on the first cylinder-jacket-shaped section 139*a* of the side wall outer surface 139 of the stopper 133. The rotary latches 78 remain here in the starting position thereof.

When the stopper-sliding edge 138*c* and the first locking-bolt-enclosing edges 109*a* are level, a change in guidance takes place. As the stopper 133 is pressed in further, the stopper-sliding edge 138*c* of the stopper 133 slides along the locking-bolt-enclosing surfaces 109 of the rotary latches 78 from the first locking-bolt-enclosing edges 109*a* onto the second locking-bolt-enclosing edges 109*b*. Owing to the conicity of the locking-bolt-enclosing surfaces 109 and driven by the force of the rotary latch springs 115, the rotary latches 78 move somewhat towards each other with the locking-bolt-enclosing surfaces 109 thereof.

Even before the stopper-sliding edge 138*c* has come level with the second locking-bolt-enclosing edges 109*b*, a change in guidance takes place again. The first locking-bolt-enclosing edges 109*a* are now placed onto the actuating surface 15 of the bolt head 12 and slide along the actuating surface 15 and subsequently along the conically tapering bolt outer-surface section 16 until the first locking-bolt-enclosing edges 109*a* are arranged in the transition region from the conically tapering bolt outer-surface section 16 to the cylindrical bolt outer-surface section 18. The locking-bolt-enclosing surfaces 109 then enclose the conically tapering bolt outer-surface section 16 in a substantially form-fitting manner. While the first locking-bolt-enclosing edges 109*a* slide along the conically tapering bolt outer-surface section 16, the rotary latches 78 move towards each other by the locking-bolt-enclosing surfaces 109 thereof.

In the process, the stopper 133 is moved successively out of the gripping region of the locking-bolt-enclosing surfaces 109. In the closed position, the stopper 133 is therefore no longer arranged between the locking-bolt-enclosing surfaces 109. However, the stopper 133 is displaced only to the extent such that it is always still arranged between the blocking lugs 110. In particular, the stopper 133 is arranged with the first cylinder-jacket-shaped section 139*a* thereof between the blocking lugs 110. The blocking lugs 110 expediently bear by means of the sliding surface 111*a* thereof against the first cylinder-jacket-shaped section 139*a* of the side-wall outer surface 139 of the stopper 133.

When the unit consisting of the stopper 133, bearing ring 134 and driving levers 135 is displaced towards the second ram 94, the second ram 94 also passes into the bearing ring cutout 158 until the actuating surface 103 of the second ram 94 bears against the actuating surfaces 168*a* of the actuating lugs 168 of the driving levers 135 without first of all actuating the driving levers 135. The two rams 40, 94 lie opposite each other, as seen in a direction parallel to the insertion direction 180.

In the position thereof enclosing and latching the locking bolt 4, the locking-bolt-enclosing surfaces 109 are closer to each other than in the starting position when the first locking-bolt-enclosing edges 109*a* bear against the first cylinder-jacket-shaped section 139*a* of the side-wall outer surface 139 of the stopper 133. As a consequence, the rotary latches 78 are rotated in relation to the starting position thereof. In particular, the rotary latches 78 are rotated in relation to the blocking bushing 118 in such a manner that the locking lugs 128 are each arranged in alignment with the blocking troughs 112, as seen in a direction parallel to the actuating axis 76. Driven by the force of the blocking bushing spring 130, the blocking bushing 118 now moves further towards the rotary latches 78, with the locking lugs 128 snapping into the blocking troughs 112. Said blocking lugs are retained there owing to the force of the blocking bushing spring 130. As a result, the rotary latches 78 are blocked and can no longer be rotated. The rotary latches 78 are therefore locked or latched in the position thereof enclosing and latching the locking bolt 4. In particular, the rotary latches 78 can no longer be rotated counter to the rotary-latch-closing direction 117 counter to the force of the rotary latch springs 115. The locking bolt 4 is therefore securely enclosed by the locking-bolt-enclosing surfaces 109 and can no longer be pulled out of the female arrester part 3.

In addition, owing to the rotation of the rotary latches 78 relative to the blocking bushing 118 and the snapping of the blocking bushing 118 into the blocking troughs 112, the blocking lugs 110 protrude into the blocking bushing 118. In particular, the lug surfaces 111*b* of the blocking lugs 118 bear against the recesses 123. This also prevents rotation of the rotary latches 78 counter to the rotary-latch-closing direction 117.

The vehicle door is locked relative to the vehicle body. The arrester 1 is in the closed or securing position thereof.

In addition, in said closed or securing position (FIG. 2), the expansion bellows 61 bears with the bellows wall 62 thereof against the cover plate 171 in a sealing manner such that dirt cannot penetrate into the female arrester part 3. The expansion bellows 61 here is compressed.

Figure 4:
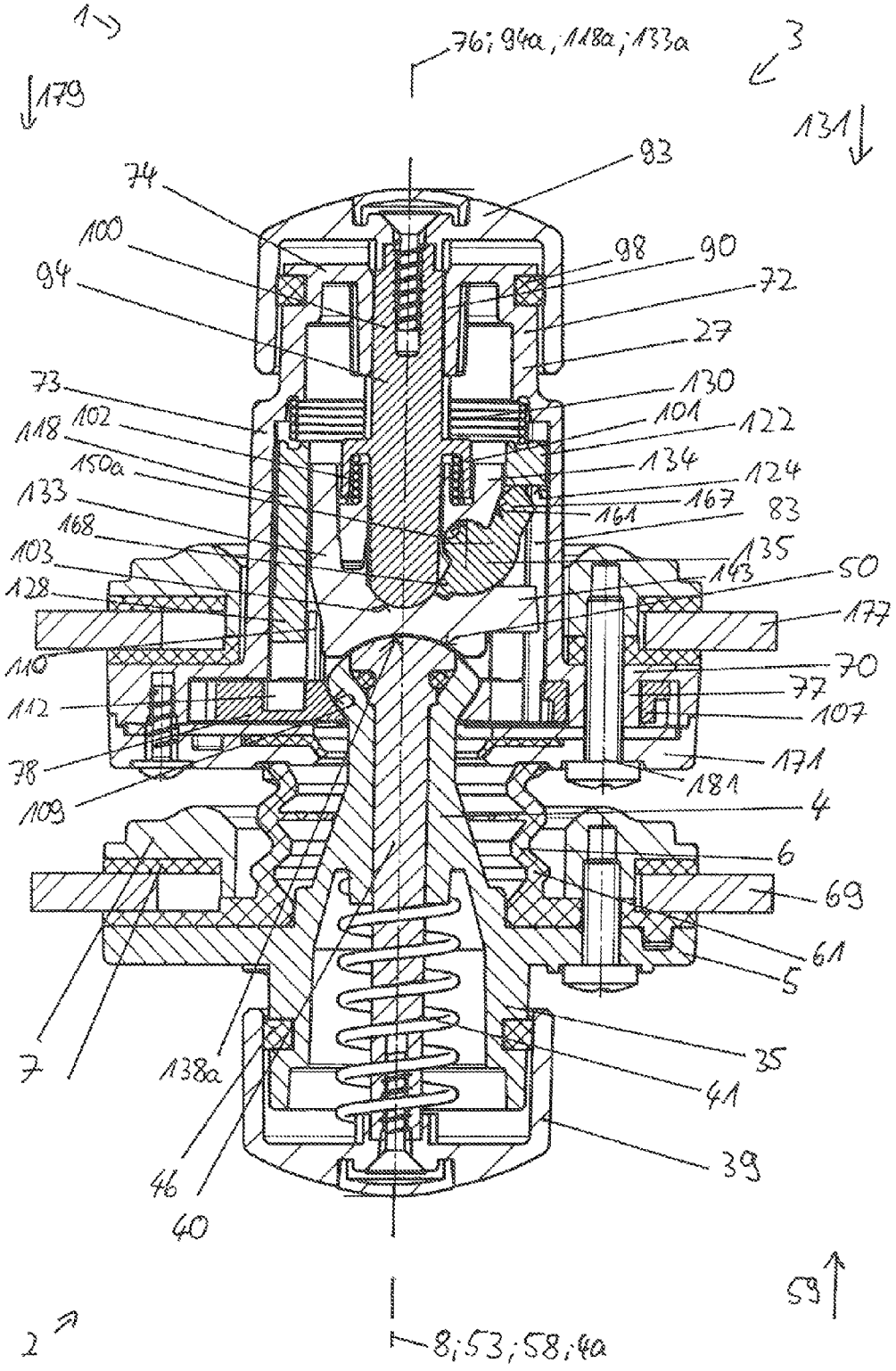
FIG. 4: shows a longitudinal section of an arrester according to the invention, in which a second pushbutton is actuated.
Figure 5:
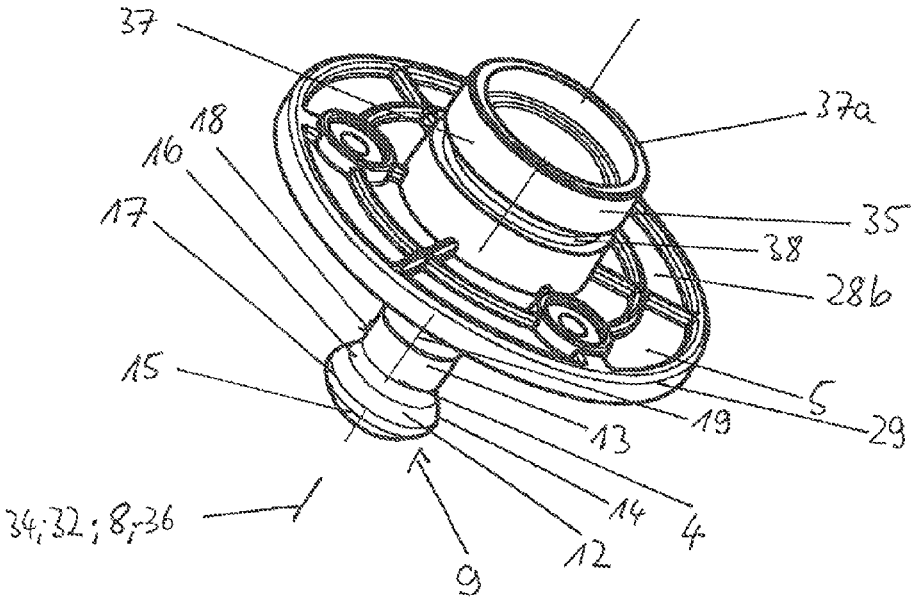
FIG. 5: shows a perspective view of the locking bolt, mounting plate and pushbutton mounting sleeve of a male arrester part of the arrester according to the invention.
Figure 6:
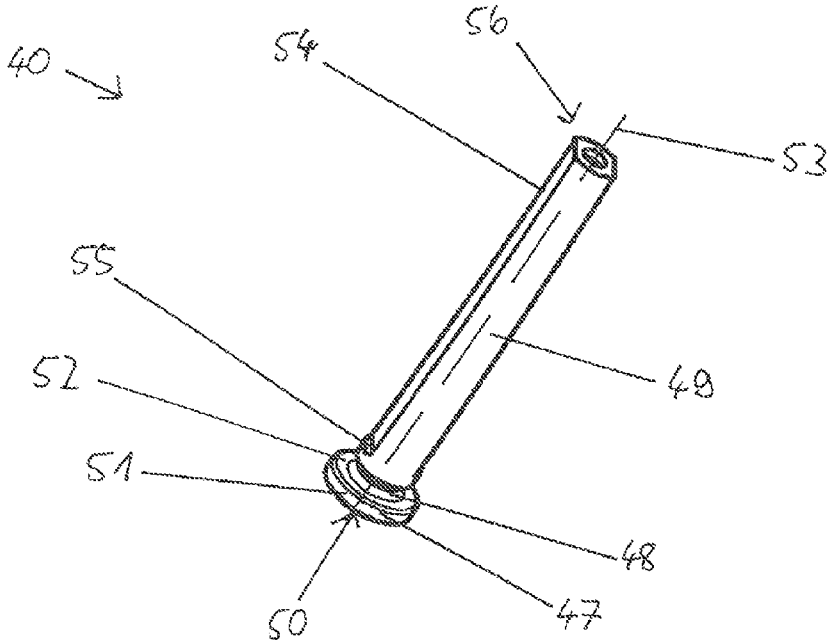
FIG. 6: shows a perspective view of a ram of the male arrester part.
Figure 7:
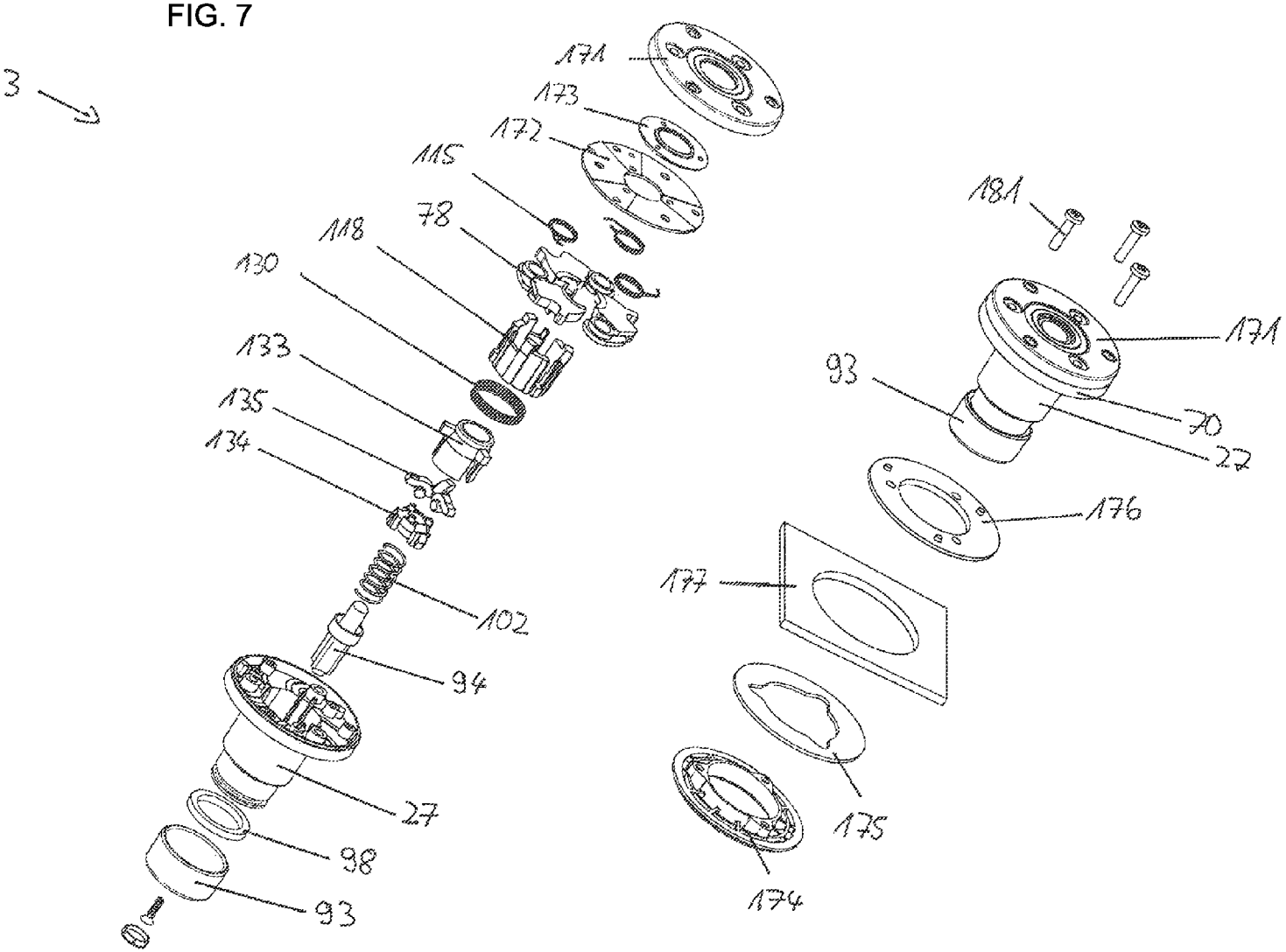
FIG. 7: shows an exploded illustration of a female arrester part of the arrester according to the invention.
Figure 8:
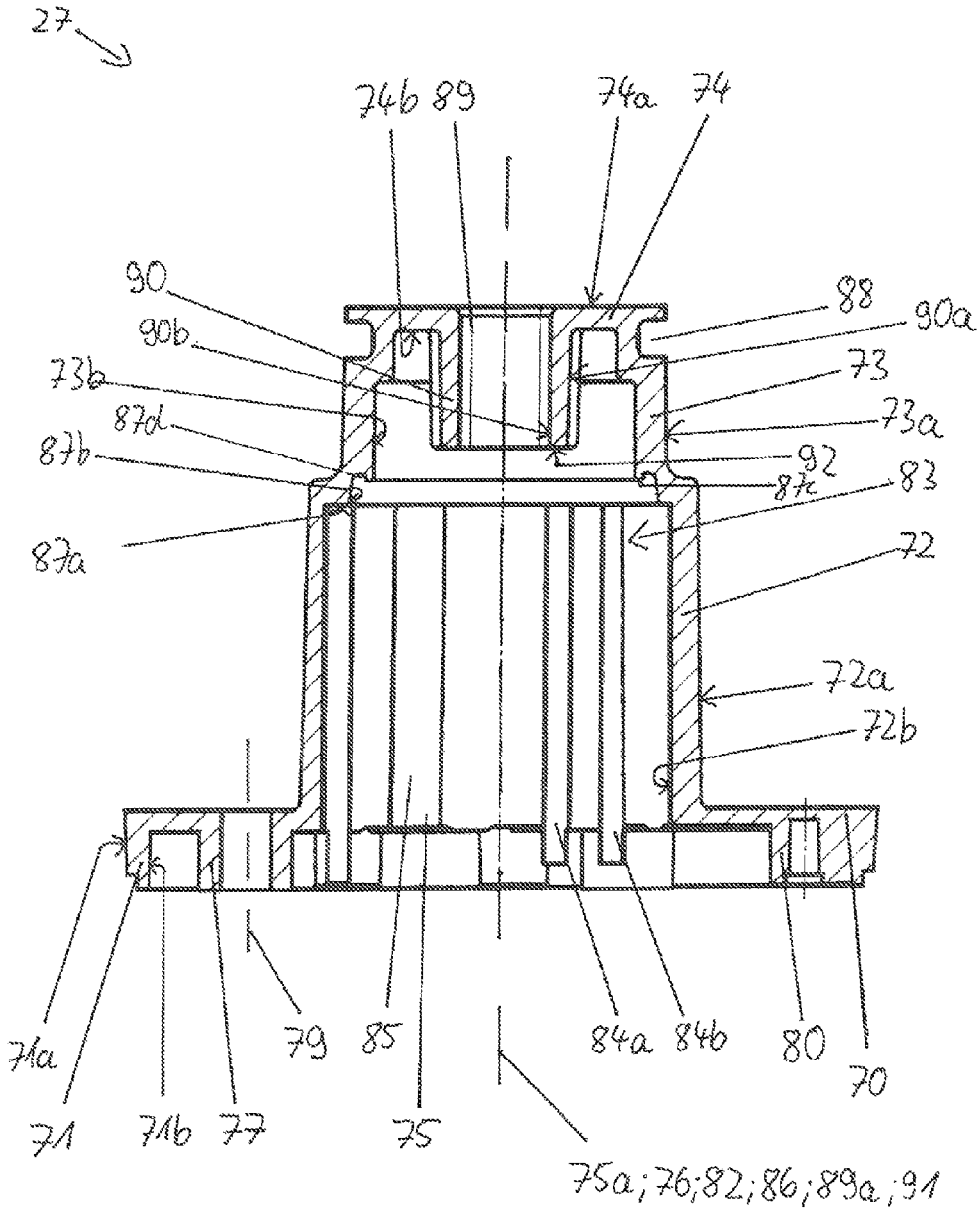
FIG. 8: shows a longitudinal section of a housing of the female arrester part.
Figure 9:
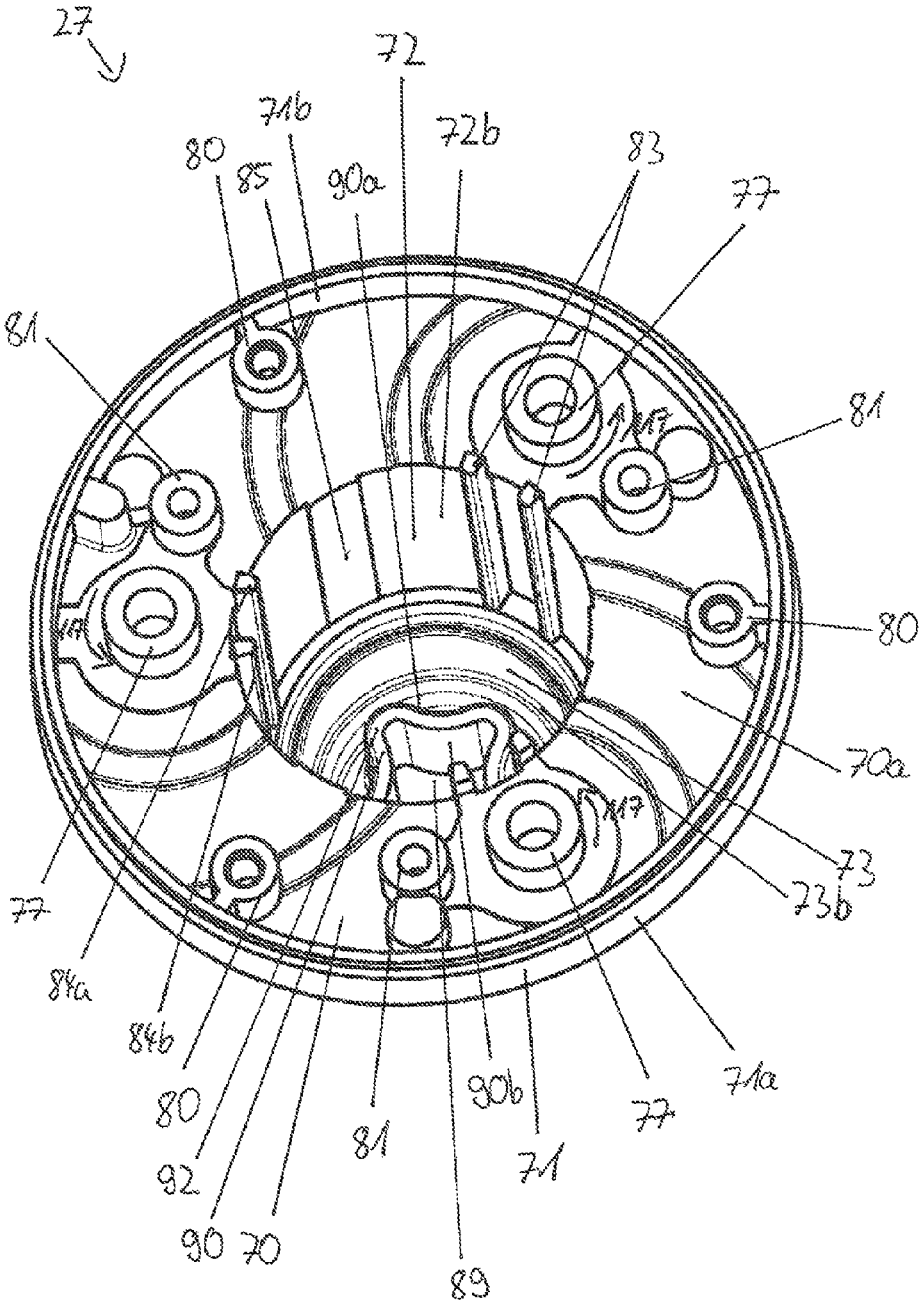
FIG. 9: shows a perspective view of the housing plate side of the housing of the female arrester part.
Figure 10:
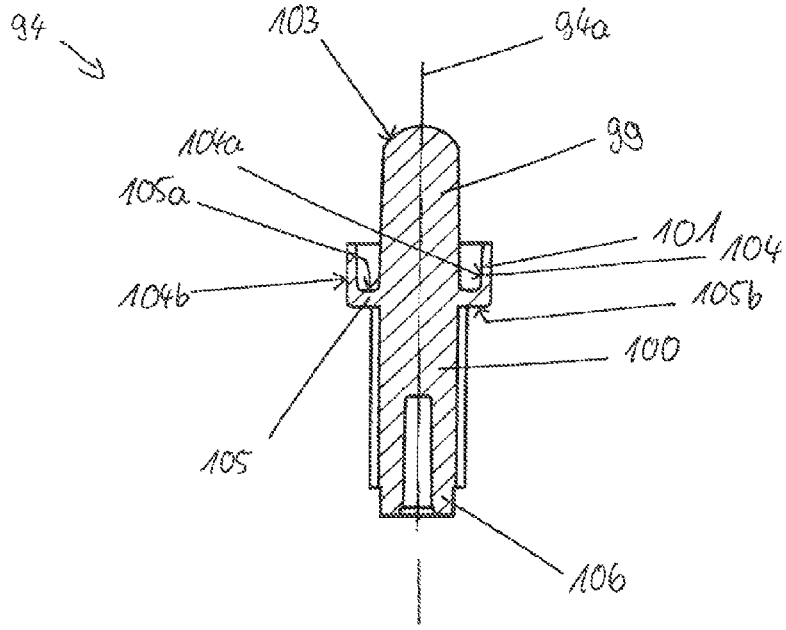
FIG. 10: shows a longitudinal section of a ram of the female arrester part.
Figure 11:
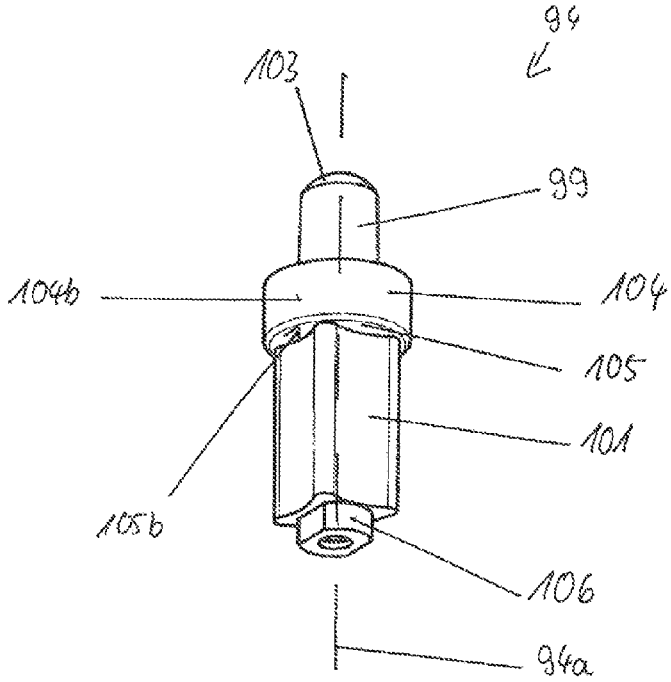
FIG. 11: shows a perspective side view of the ram of the female arrester part.
Figure 12:
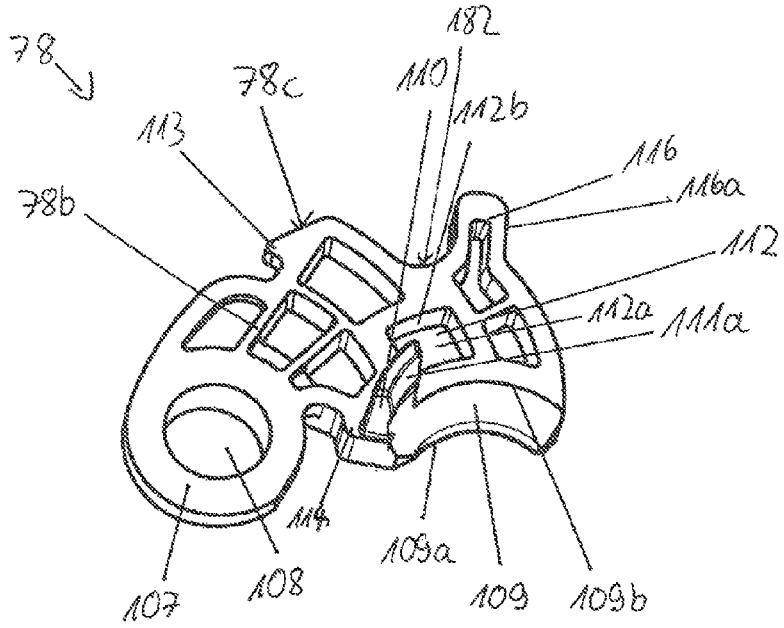
FIG. 12: shows a perspective top view of a rotary latch of the female arrester part on a second rotary latch surface.
Figure 13:
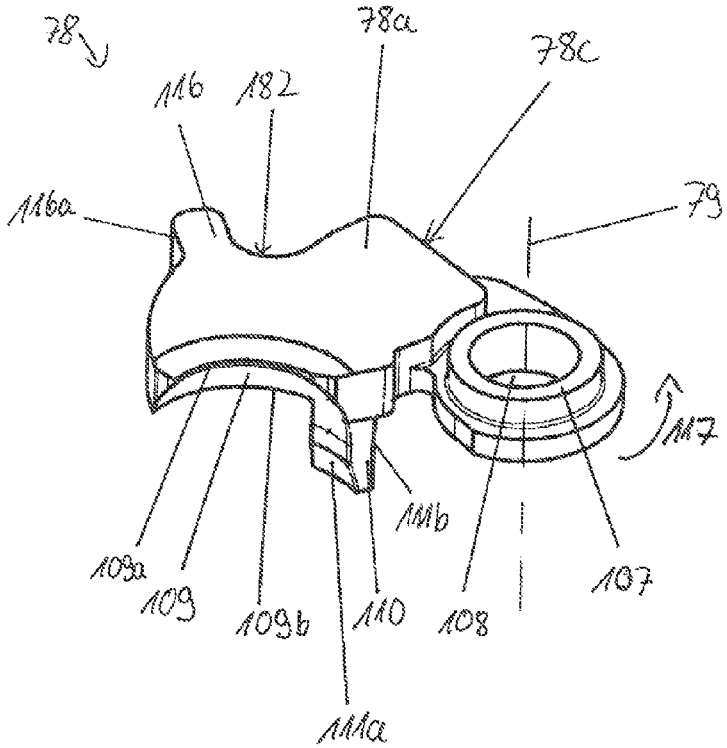
FIG. 13: shows a perspective top view of the rotary latch of the female arrester part on a first rotary latch surface.
Figure 14:
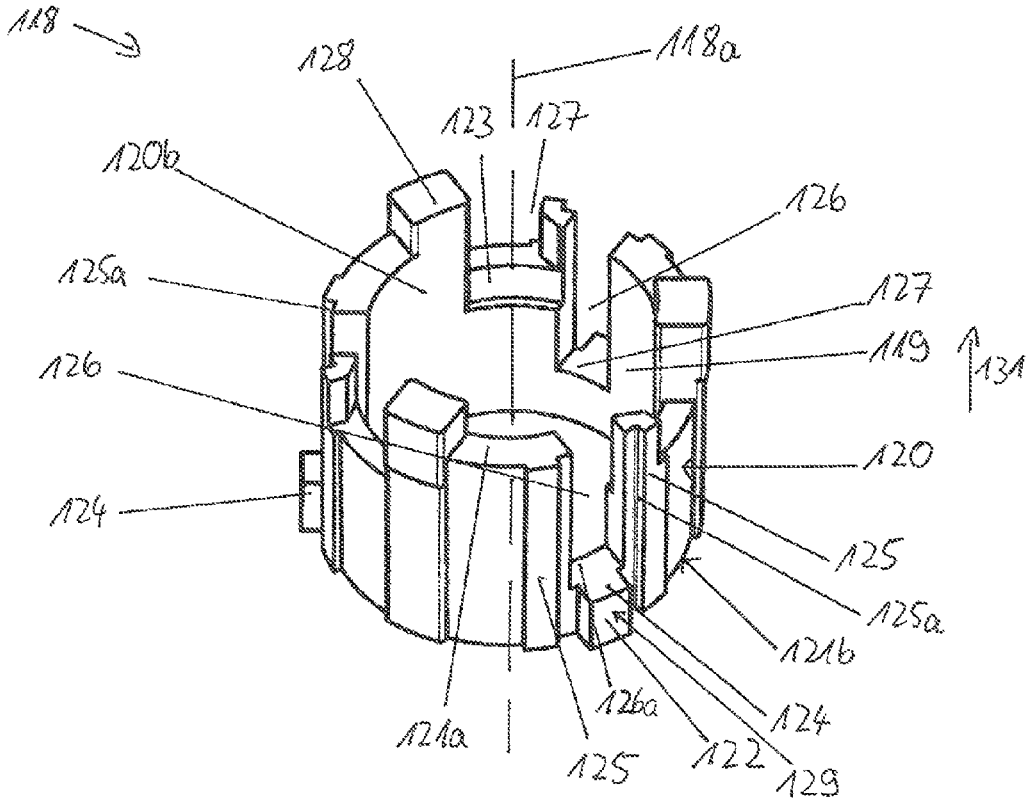
FIG. 14: shows a perspective side view of a blocking bushing of the female arrester part.
Figure 15:
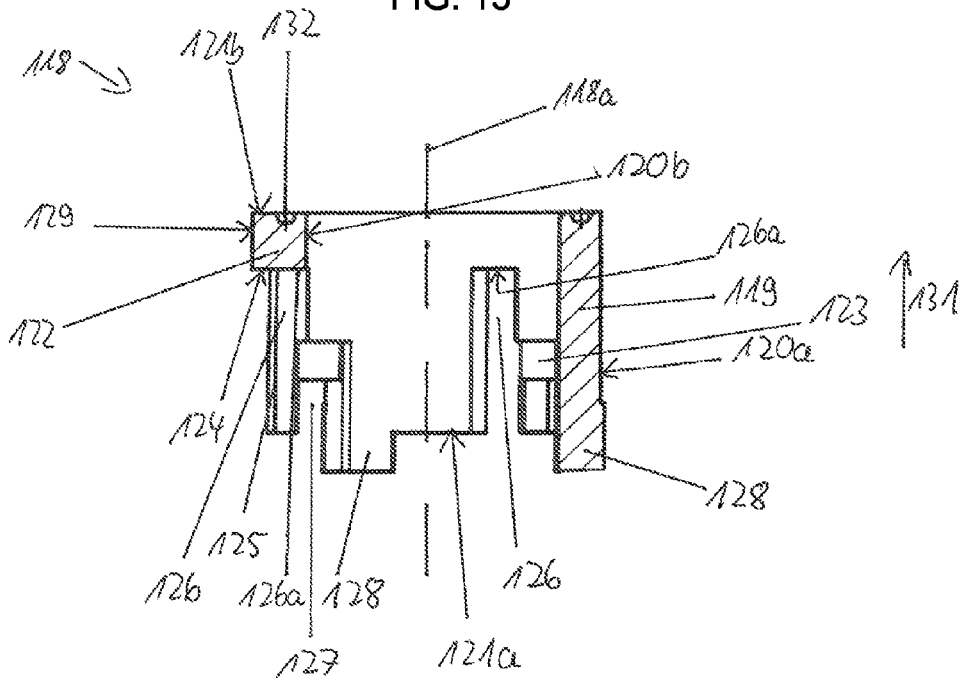
FIG. 15: shows a longitudinal section of the blocking bushing of the female arrester part.
Figure 16:
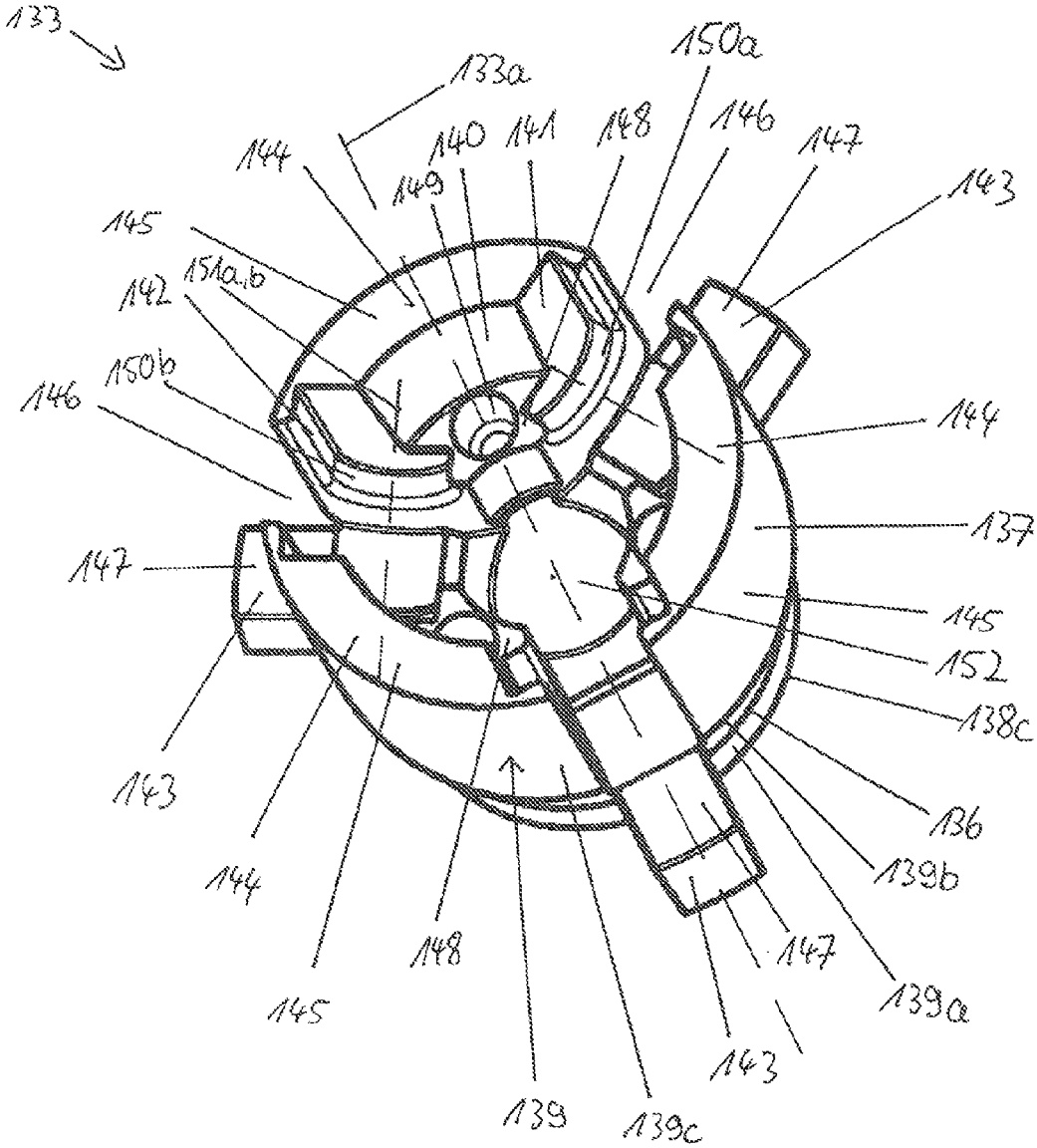
FIG. 16: shows a perspective top view of a stopper of the female arrester part
Figure 17:
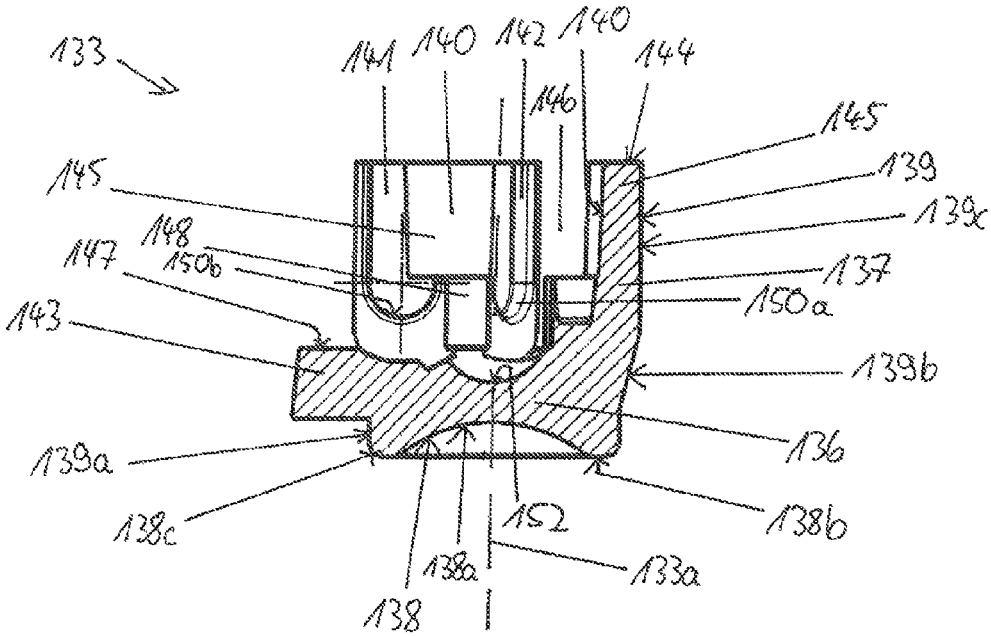
FIG. 17: shows a longitudinal section of the stopper of the female arrester part.
Figure 18:
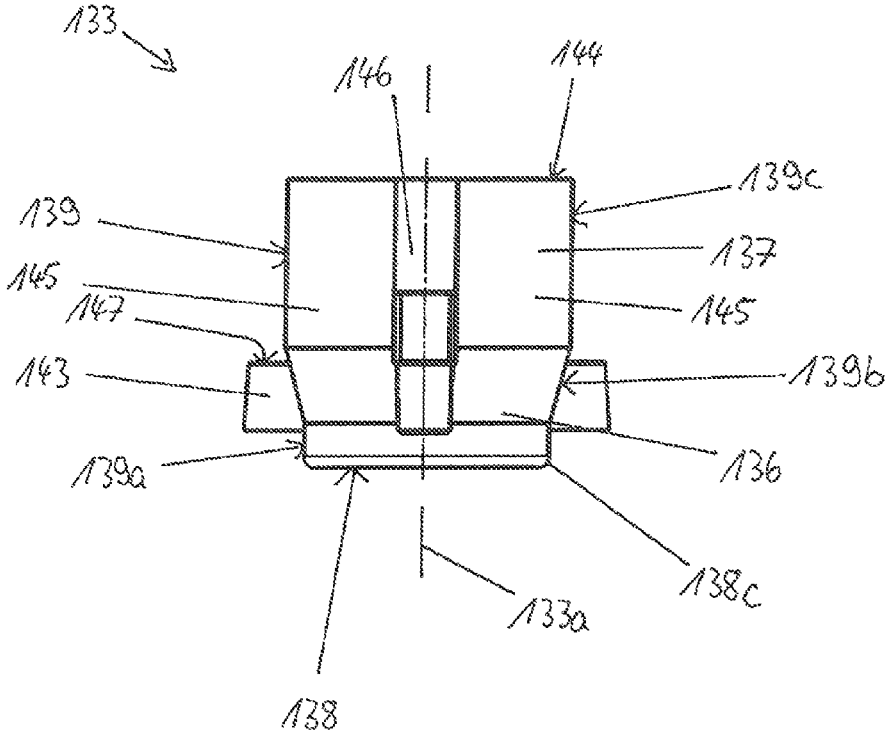
FIG. 18: shows a side view of the stopper of the female arrester part
Figure 19:
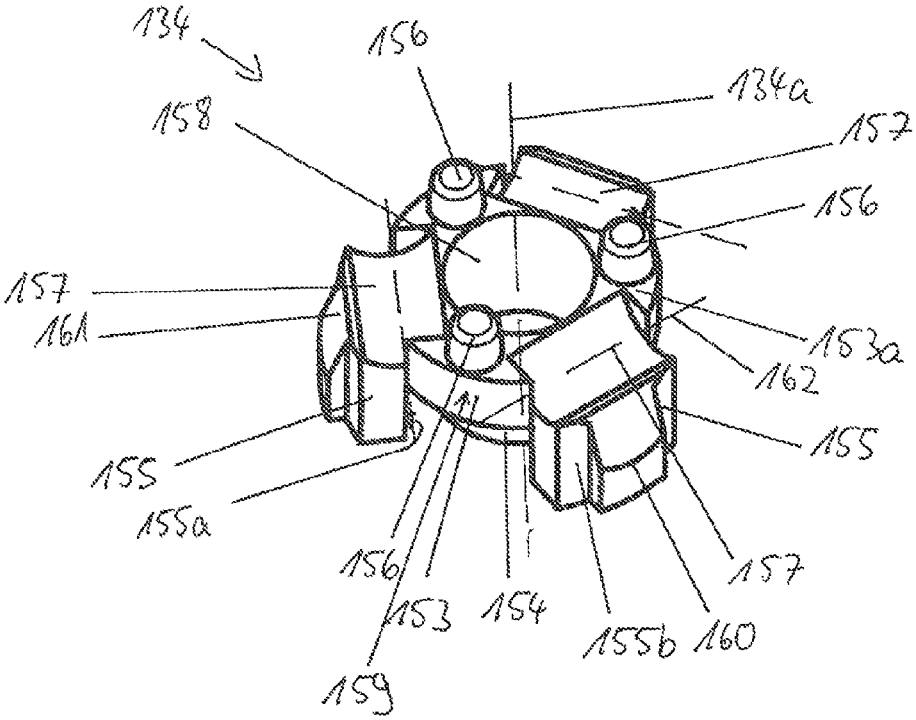
FIG. 19: shows a perspective top view of a bearing ring of the female arrester part on a first ring surface.
Figure 20:
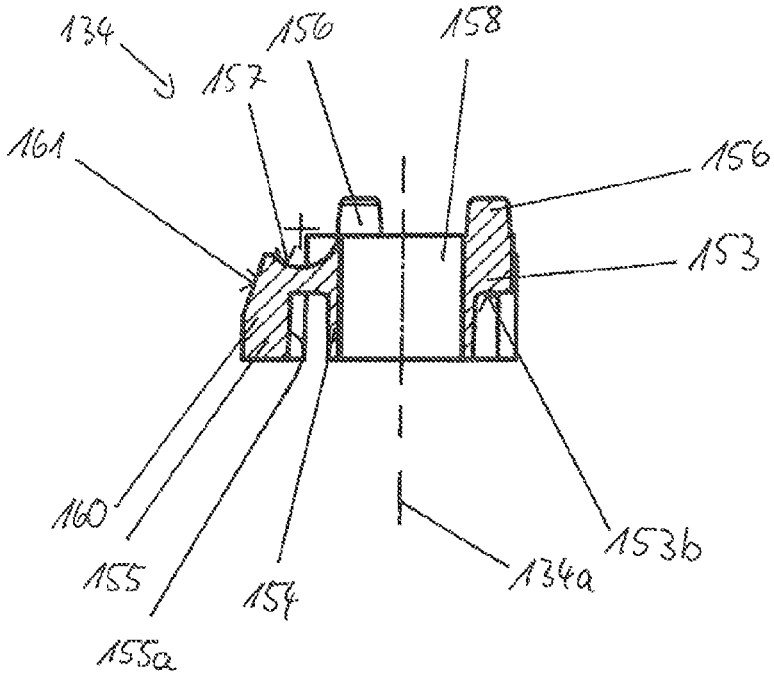
FIG. 20: shows a longitudinal section of the bearing ring of the female arrester part.
Figure 21:
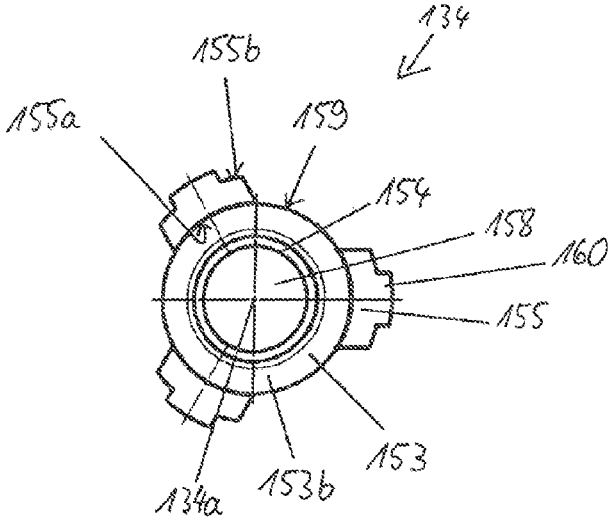
FIG. 21: shows a top view of the bearing ring of the female arrester part on a second ring surface.
Figure 22:
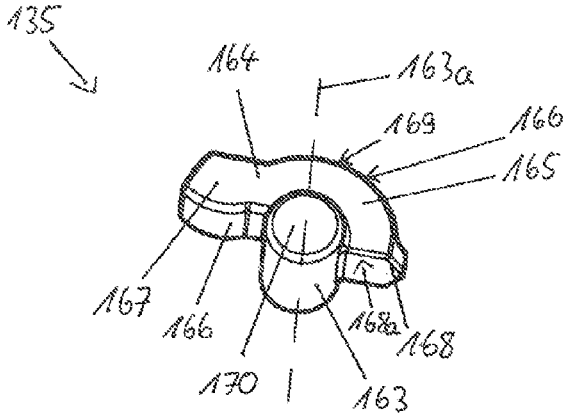
FIG. 22: shows a perspective side view of a driving lever of the female arrester part.
Figure 23:
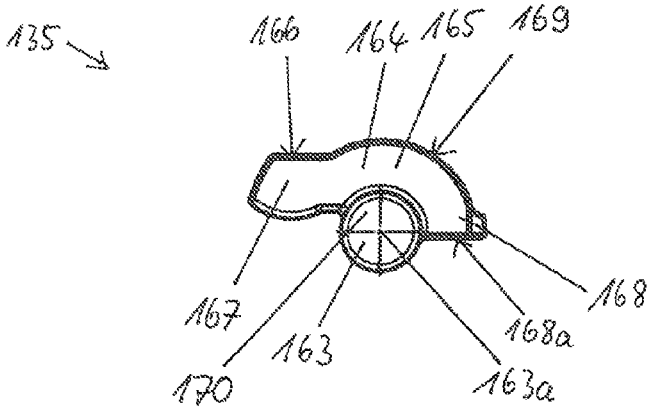
FIG. 23: shows a side view of the driving lever of the female arrester part.
Figure 24:
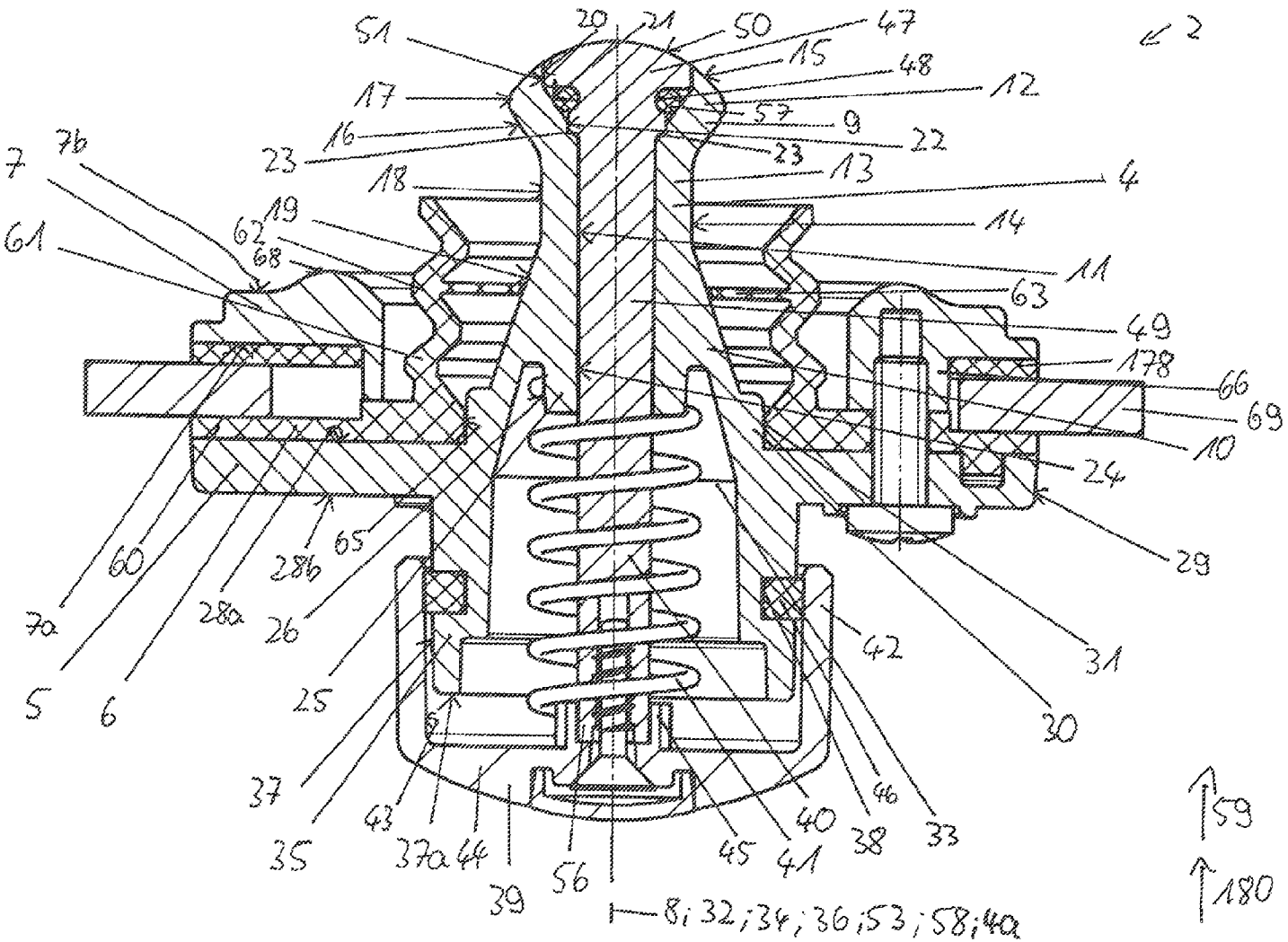
FIG. 24: shows a longitudinal section of the male arrester part.

In the case of the door arrester 1 according to the invention, the latching of the rotary latches 78 can be released both by manual actuation of the first pushbutton 39 (FIG. 3) and by manual actuation of the second pushbutton 93 (FIG. 4).

If the first pushbutton 39 is pressed in the pushbutton-actuating direction 59 counter to the force of the first pushbutton spring 41, the first ram 40 is displaced, as already described above, in the first pushbutton-actuating direction 59 relative to the locking bolt 4 by the first pushbutton 39. In the process, the ram head 47 is extended out of the bolt head 12. The first ram 40 acts with the head surface 50 of the ram head 47 thereof on the stopper-actuating surface 138*a* and presses onto the latter. As a result, the stopper 133, and together therewith the bearing ring 134 and the driving levers 135, is moved further in the insertion direction 180 or in the first pushbutton-actuating direction 59 towards the second ram 94 and the second pushbutton 93. In the process, the second pushbutton spring 102 is further compressed.

In addition, the blocking bushing 118, driven by the stopper 133, is displaced counter to the blocking-bushing-latching direction 131, i.e. in the insertion direction 180. In particular, the blocking bushing 118 is carried along by the stopper 133 in a form-fitting manner, since the guiding lugs 143 bear against the supporting lugs 167 of the driving levers 135, and the supporting lugs 167 bear against the slot end edges 126*a* and the lug-supporting surfaces 124. The blocking bushing 118 is therefore driven counter to the blocking-bushing-latching direction 131 by the stopper 133 in a form-fitting manner via the guiding lugs 143, the supporting lugs 167, the slot end edges 126*a* and the lug-supporting surfaces 124.

However, in addition to the movement with the stopper 133, the blocking bushing 118 is expediently also displaced counter to the blocking-bushing-latching direction 131 relative to the stopper 133. This is brought about by, during the movement of the unit consisting of the stopper 133, bearing ring 134 and driving levers 135 in the first pushbutton-actuating direction 59, the second ram 94 pressing with the actuating surface 103 thereof onto the actuating surfaces 168*a* of the actuating lugs 168 of the driving levers 135. As a result, the driving levers 135 are pivoted about the shaft axes 163*a* thereof in such a manner that the actuating lugs 168 are moved towards the stopper base wall 136 or the trough 152. As a result, the supporting lugs 167 are moved away from the stopper base wall 136 and the supporting surfaces 147 of the guiding lugs 143 of the stopper 133. The supporting lugs 167 are therefore raised from the supporting surfaces 147 of the guiding lugs 143 of the stopper 133. Since the supporting lugs 167 act on the slot end edges 126*a* and the lug-supporting surfaces 124 of the guiding lugs 122 of the blocking bushing 118, the guiding lugs 122 of the blocking bushing 122 and the guiding lugs 143 of the stopper 133 are pressed apart and, as a result, the blocking bushing 118 is displaced counter to the blocking-bushing-latching direction 131 relative to the stopper 133 and to the bearing ring 134.

By means of the dual combined movement of the blocking bushing 118 counter to the blocking-bushing-latching direction 131, the locking lugs 128 move out of the blocking troughs 112. In addition, the first bushing border 121*a* is displaced counter to the blocking-bushing-latching direction 131 relative to the rotary latches 78 to an extent such that the blocking lugs 110 can pass the rotary latches 78 upon rotation thereof. As a result, the rotary latches 78 are no longer locked or are unlocked. The rotary latches 78 can now be rotated counter to the rotary-latch-closing direction 117 counter to the force of the rotary latch springs 115.

The locking bolt 4 is now pressed automatically out of the female arrester part 3 by the force of the second pushbutton spring 102 which moves the unit consisting of the stopper 133, bearing ring 134 and driving levers 135 towards the rotary latches 78 counter to the insertion direction 180. Since the stopper-actuating surface 138*a* bears against the head surface 50 of the first ram 40, said ram is moved together with the unit. Since, at this moment, the first pushbutton 39 is still pressed and the first ram 40 is, as a result, held in the extended position with respect to the locking bolt 4, the ram 40 and locking bolt 4 are first of all pressed out of the female arrester part 3 in the extended position. This is assisted by the force of the expansion bellows 61 which likewise presses the locking bolt 4 out of the second arrester part 3.

If the first pushbutton 39 is released, the first ram 40 is automatically retracted again by the force of the first pushbutton spring 41 and moved into the unactuated position thereof. In the process, the first pushbutton 39 is also moved automatically into the unactuated position thereof. The first ram 40 moves here counter to the first pushbutton-actuating direction 59 and counter to the insertion direction 180. The stopper-actuating surface 138*a* now also bears against the actuating surface 15 of the locking bolt 4.

When the stopper 133 is moved out, the conical bolt outer-surface section 16 first of all slides along the locking-bolt-enclosing surfaces 109. Owing to the conicity of the locking-bolt-enclosing surfaces 109 and the conicity of the bolt outer-surface section 16, the locking-bolt-enclosing surfaces 109 are pressed apart. That is to say, the rotary latches 78 pivot counter to the rotary-latch-closing direction 117 counter to the force of the rotary latch springs 115. The rotary latches 78 are therefore rotated relative to the blocking bushing 118. As a result, the locking lugs 128 are no longer arranged in alignment with the blocking troughs 112. The locking lugs 128 can therefore no longer snap into the blocking troughs 112 when the blocking bushing 118 reaches the rotary latches 78.

If the bolt head edge 17 and the first locking-bolt-enclosing edges 109*a* are level, a change in guidance takes place. Upon the locking bolt 4 being pressed further out, the first locking-bolt-enclosing edges 109*a* slide towards the stopper 133 along the actuating surface 15 of the bolt head 12. In the process, the locking-bolt-enclosing surfaces 109 are again pressed somewhat towards each other, but not as far as in the closed position. This continues to ensure that the locking lugs 128 cannot snap into the blocking troughs 112.

The first locking-bolt-enclosing edges 109*a* slide along the actuating surface 15 of the bolt head 12 until the stopper-sliding edge 138*c* strikes against the locking-bolt-enclosing surfaces 109.

The stopper-sliding edge 138*c* now slides along the locking-bolt-enclosing surfaces 109 until the stopper-sliding edge 138*c* is level with the first locking-bolt-enclosing edges 109*a*. Owing to the conicity of the locking-bolt-enclosing surfaces 109, the locking-bolt-enclosing surfaces 109 are again pressed apart into the starting position thereof.

The first locking-bolt-enclosing edges 109*a* subsequently slide along the first cylinder-jacket-shaped section 139*a* until the stopper 133 has reached the starting position thereof again.

The unit consisting of the stopper 133, bearing ring 134 and driving levers 135 is therefore moved into the starting position thereof driven by the force of the second pushbutton spring 102.

Owing to the force of the blocking bushing spring 130, the blocking bushing 118 is likewise moved in the blocking-bushing-latching direction 131. In the process, the slot end edges 126*a* and the lug-supporting surfaces 124 of the guiding lugs 122 of the blocking bushing 118 press onto the supporting lugs 167 by means of the force of the blocking bushing spring 130 and bring about a resetting moment on the driving levers 135. As a result, the driving levers 135 are pivoted back into the starting position thereof and the blocking bushing 118 is moved in the blocking-bushing-latching direction 131 relative to the stopper 133.

However, when the blocking bushing 118 arrives at the rotary latches 78, the blocking troughs 112 are offset with respect to the locking lugs 128 of the blocking bushing 118 in such a manner that the locking lugs 128 cannot snap into the blocking troughs 112 (see above). The locking lugs 128, offset with respect to the blocking troughs 112, are therefore pressed onto the second rotary-latch surfaces 78*b* of the rotary latches 78.

As an alternative, the latching of the rotary latches 78 may also be released by pressing the second pushbutton 93 (FIG. 4).

If the second pushbutton 93 is pressed in counter to the force of the second pushbutton spring 102, the second ram 94 is displaced relative to the stopper 133 in a second pushbutton-actuating direction 179 which is opposed to the first pushbutton-actuating direction 59. In the process, the second pushbutton spring 102 is compressed. In addition, the second ram 94 moves further into the stopper 133, and with its actuating surface 103 presses onto the actuating surfaces 168*a* of the actuating lugs 168 of the driving levers 135. The second ram 94 preferably moves into the stopper 133 until the ram-actuating surface 103 butts against the trough 152.

As a result, the driving levers 135 are pivoted about the shaft axes 163*a* thereof in such a manner that the actuating lugs 168 are moved toward the stopper base wall 136. The supporting lugs 167 are thereby moved away from the stopper base wall 136 and the supporting surfaces 147 of the guiding lugs 143 of the stopper 133. The supporting lugs 167 are therefore raised from the supporting surfaces 147 of the guiding lugs 143 of the stopper 133. Since the supporting lugs 167 act on the slot end edges 126*a* and the lug-supporting surfaces 124 of the guiding lugs 122 of the blocking bushing 118, the guiding lugs 122 of the blocking bushing 118 and the guiding lugs 143 of the stopper 133 are pressed apart and, as a result, displace the blocking bushing 118 relative to the stopper 133 and to the bearing ring 134. The blocking bushing spring 130 is compressed in the process. By means of the movement of the blocking bushing 118 counter to the blocking-bushing-latching direction 131, the locking lugs 128 are again moved out of the blocking troughs 112 and the rotary latches 78 are unlocked. The rotary latches 78 can now be rotated again counter to the rotary-latch-closing direction 117 counter to the force of the rotary latch springs 115.

The unit consisting of the stopper 133, bearing ring 134 and driving levers 135 is now moved again by the force of the second pushbutton spring 102 towards the rotary latches 78 counter to the insertion direction 180. Since the stopper base surface 138 bears against the head surface 50 of the first ram 40 and against the actuating surface 15 of the locking bolt 4, the retracted first ram 40 and the locking bolt 4 are carried along or driven in a form-fitting manner by the unit and are pressed out of the female arrester part 3. This is again assisted by the force of the expansion bellows 61 which likewise presses the locking bolt 4 out of the second arrester part 3.

The movement of the locking bolt 4 out of the female arrester part 3 and the movement of the stopper 133 and of the rotary latches 78 proceed as during the unlocking by means of the first pushbutton mechanism.

Owing to the force of the blocking bushing spring 130, the blocking bushing 118 is in turn also moved in the blocking-bushing-latching direction 131 towards the rotary latches 78. In the process, by means of the force of the blocking bushing spring 130, the slot end edges 126*a* and the lug-supporting surfaces 124 of the guiding lugs 122 of the blocking bushing 118 press onto the supporting lugs 167 and bring about a resetting moment on the driving levers 135. As a result, the driving levers 135 are pivoted back into the starting position thereof and the blocking bushing 118 is moved in the blocking-bushing-locking direction 131 relative to the stopper 133.

When the blocking bushing 118 arrives with the locking lugs 128 thereof at the rotary latches 78, the rotary latches 78 are rotated in relation to the blocking bushing 118 in such a manner that the locking lugs 128 cannot snap into the blocking troughs 112 (see above).

According to the invention, the locking of the rotary latch mechanism by the blocking bushing 118 serving as a blocking element can therefore be released by actuation either of the first or of the second pushbutton mechanism. The two pushbutton mechanisms, the stopper 133, the bearing ring 134 and the three driving levers 135 serve as means for releasing the locking of the rotary latch mechanism or as means for actuating the blocking element in such a manner that the locking is released. In this case, the stopper 133, the bearing ring 134 and the three driving levers 135 serve as coupling means or movement transmission means or driving means or actuating means, by means of which the movement of the rams 40, 94 is in each case transmitted to the blocking bushing 118 in such a manner that the blocking bushing 118 is moved out of the locking position thereof.

A first advantage of the door arrester 1 according to the invention is that it ensures reliable insertion and holding and enclosing of the locking bolt 4 even if the locking bolt axis 4*a* is not coaxial with respect to the second actuating axis 76. Differences of up to 3° are entirely harmless. This is advantageous in particular in hingedly mounted vehicle doors or vehicle hatches. The arrester according to the invention therefore has high functional reliability.

In addition, the fitting of the door arrester 1 according to the invention, in particular in glass windows, is simpler and more cost-effective than in the case of the previously known door arrester, since the door arrester according to the invention does not have to be secured against rotation, and therefore an additional bore necessary for this purpose in the glass window is spared.

Of course, it also lies within the scope of the invention to use the door arrester 1 according to the invention in sliding doors and not only in hingedly mounted doors/hatches.

What is claimed is:

1. An arrester for locking a vehicle door or vehicle hatch or the like in the open position thereof, comprising:

a male arrester part for fastening to a first vehicle part, with a locking bolt, and a female arrester part for fastening to a second vehicle part, configured for inserting the locking bolt into the female arrester part, the female arrester part having a rotary latch mechanism for latching the inserted locking bolt and a blocking element for locking the rotary latch mechanism in a position latching the locking bolt, the male arrester part having a first pushbutton mechanism and the female arrester part having a second pushbutton mechanism, the blocking element being configured to be actuated by actuating one of the first and second pushbutton mechanisms, wherein an actuation of the blocking element unlocks the rotary latch mechanism, the unlocked latch mechanism allowing the locking bolt to be unlatched.

2. The arrester according to claim 1, further comprising that the male arrester part has a first actuating axis and the first pushbutton mechanism has a first pushbutton and a first ram arranged in the locking bolt, the first ram being displaceable within a limited range in a direction parallel to the first actuating axis.

3. The arrester according to claim 2, further comprising that an actuation of the first pushbutton moves the first ram, causing the first ram to actuate the blocking element.

4. The arrester according to claim 3, further comprising that an actuation of the first pushbutton moves the first ram telescopically out of the locking bolt, extending the first ram to a position in which the first ram actuates the blocking element.

5. The arrester according to claim 2, further comprising that the first ram has a ram head with a surface facing outward from the locking bolt.

6. The arrester according to claim 5, further comprising that the ram head has a partially spherical shape.

7. The arrester according to claim 2, further comprising that the female arrester part has a second actuating axis and the second pushbutton mechanism has a second pushbutton and a second ram that is displaceable within a limited range in a direction parallel to the second actuating axis.

8. The arrester according to claim 7, further comprising that an actuation of the second pushbutton moves the second ram, causing the second ram to actuate the blocking element.

9. The arrester according to claim 7, further comprising that, in a locked position of the rotary latch mechanism, the first and second rams are arranged opposite each other.

10. The arrester according to claim 9, further comprising that, in a locked position of the rotary latch mechanism, the first and second actuating axes are coaxial.

11. The arrester according to claim 7, further comprising that the arrester has coupling means or movement transmission means transmitting the movement of the first and second rams to the blocking element and causing the blocking element to unlock the rotary latch mechanism.

12. The arrester according to claim 1, further comprising that the rotary latch mechanism has at least two rotary latches.

13. The arrester according to claim 12, further comprising that the rotary latches each have a locking-bolt-enclosing surface adapted to the shape of the locking bolt.

14. The arrester according to claim 13, further comprising that the locking-bolt-enclosing surfaces each have a partially spherical shape.

15. The arrester according to claim 13, further comprising that the locking-bolt-enclosing surfaces define an aperture extending from a first rotary latch radius to a second rotary latch radius and are adapted to a wider locking bolt radius proximate to the second rotary latch radius than proximate the first rotary latch radius.

16. The arrester according to claim 15, further comprising that a first locking-bolt-enclosing edge bounds the locking-bolt-enclosing surface on the first rotary latch surface and a second locking-bolt-enclosing edge bounds the locking-bolt-enclosing surface on the second rotary latch surface.

17. The arrester according to claim 12, further comprising that the rotary latches are each mounted in a housing of the female arrester part and are rotatable about a rotary-latch axis of rotation.

18. The arrester according to claim 17, further comprising that the female arrester part has a second actuating axis and the rotary-latch axis of rotation is parallel to the second actuating axis of the female arrester part.

19. The arrester according to one of claim 12, further comprising that the rotary latches each have a blocking trough.

20. The arrester according to claim 19, further comprising that the female arrester part has a second actuating axis and the blocking element is a blocking bushing displaceable within a limited range parallel to the second actuating axis in a housing of the female arrester part and the blocking bushing has at least two locking lugs configured to interact with the blocking troughs to cause locking of the rotary latches.

21. The arrester according to claim 20, further comprising that the female arrester part has a hood-like stopper which is arranged in the housing of the female arrester part so as to be displaceable within a limited range parallel to the second actuating axis.

22. The arrester according to claim 21, further comprising that, while the male and female arrester parts are not in engagement with each other, the stopper forms an abutment limiting a rotational movement of the rotary latches in a rotary-latch-closing direction.

23. The arrester according to claim 21, further comprising that the stopper is arranged in the blocking bushing displaceable within a limited range parallel to the second actuating axis.

24. The arrester according to claim 21, further comprising that an actuation of the first or the second pushbutton mechanism drives the blocking bushing relative to the rotary latches counter to a blocking-bushing locking direction causing the locking lugs to be free to be extended out of the blocking troughs.

25. The arrester according to claim 24, further comprising that the actuation of the first pushbutton mechanism drives the stopper relative to the rotary latches counter to the blocking-bushing locking direction, and that the actuation of the first pushbutton mechanism simultaneously drives the blocking bushing relative to the stopper counter to the blocking-bushing locking direction.

26. The arrester according to claim 24, further comprising that an actuation of the second pushbutton mechanism drives the blocking bushing relative to the stopper counter to the blocking-bushing locking direction.

27. The arrester according to claim 21, further comprising that the female arrester part has at least two driving levers rotatably mounted in the stopper, the driving levers being supported at one end on the blocking bushing while the rotary latch mechanism is locked.

28. The arrester according to claim 27, further comprising that the stopper and the blocking bushing are displaceable relative to each other by rotation of the driving levers.

29. The arrester according to claim 12, further comprising that the rotary latch mechanism has three rotary latches of identical spatial shapes.

30. The arrester according to claim 1, further comprising that the female arrester part has a second actuating axis and the blocking element is a blocking bushing displaceable within a limited range parallel to the second actuating axis in a housing of the female arrester part.

* * * * *